US012235028B2

(12) United States Patent
Yoshimi

(10) Patent No.: US 12,235,028 B2
(45) Date of Patent: Feb. 25, 2025

(54) REFRIGERANT LEAKAGE DETERMINATION SYSTEM

(71) Applicant: DAIKIN INDUSTRIES, LTD., Osaka (JP)

(72) Inventor: Manabu Yoshimi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 301 days.

(21) Appl. No.: 17/689,739

(22) Filed: Mar. 8, 2022

(65) Prior Publication Data

US 2022/0187000 A1 Jun. 16, 2022

Related U.S. Application Data

(63) Continuation of application No. PCT/JP2020/033810, filed on Sep. 7, 2020.

(30) Foreign Application Priority Data

Sep. 9, 2019 (JP) ..... 2019-163492

(51) Int. Cl.
*F24F 11/36* (2018.01)
*F24F 11/38* (2018.01)
(Continued)

(52) U.S. Cl.
CPC ..... *F25B 49/02* (2013.01); *F24F 11/38* (2018.01); *F25B 40/00* (2013.01); *F25B 43/006* (2013.01);
(Continued)

(58) Field of Classification Search
CPC ..... F24F 11/36; F25B 40/00; F25B 43/006; F25B 49/02; F25B 2500/222;
(Continued)

(56) References Cited

U.S. PATENT DOCUMENTS 5,369,958 A * 12/1994 Kasai ..... F25B 13/00 62/196.3
2005/0126190 A1* 6/2005 Lifson ..... F25B 49/005 62/149
(Continued)

FOREIGN PATENT DOCUMENTS

JP 2007-71545 A 3/2007
JP 2010-7994 A 1/2010
(Continued)

OTHER PUBLICATIONS

International Prelimiary Report on Patentability and English translation of the Written Opinion of the International Search Authority, for International Application No. PCT/JP2020/033810, mailed Mar. 17, 2022.
(Continued)

*Primary Examiner* — Jonathan Bradford
(74) *Attorney, Agent, or Firm* — Birch, Stewart, Kolasch & Birch, LLP

(57) ABSTRACT

A refrigerant leakage determination system includes a refrigerant circuit including a compressor, a condenser, an expansion mechanism, and an evaporator. The system performs a first determination, and a second determination. The first determination determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor. The second determination determines that refrigerant has leaked from the refrigerant circuit, based on information different from the first state amount.

15 Claims, 5 Drawing Sheets

(51) Int. Cl.

| | |
|---|---|
| ***F25B 40/00*** | (2006.01) |
| ***F25B 43/00*** | (2006.01) |
| ***F25B 49/00*** | (2006.01) |
| ***F25B 49/02*** | (2006.01) |
| *F25B 13/00* | (2006.01) |
| *F25B 40/02* | (2006.01) |

(52) U.S. Cl.
CPC ..... *F25B 49/005* (2013.01); *F24F 11/36* (2018.01); *F25B 13/00* (2013.01); *F25B 40/02* (2013.01); *F25B 2313/0233* (2013.01); *F25B 2400/13* (2013.01); *F25B 2500/222* (2013.01); *F25B 2700/04* (2013.01); *F25B 2700/1931* (2013.01); *F25B 2700/2106* (2013.01); *F25B 2700/21151* (2013.01); *F25B 2700/21152* (2013.01); *F25B 2700/2116* (2013.01); *F25B 2700/21163* (2013.01); *F25B 2700/21174* (2013.01); *F25B 2700/21175* (2013.01)

(58) Field of Classification Search
CPC ..... F25B 2700/04; F25B 2700/1931; F25B 2700/2106; F25B 2700/21151; F25B 2700/21163; F25B 2700/21174; F25B 2700/21175
See application file for complete search history.

(56) References Cited

U.S. PATENT DOCUMENTS

| | | | | |
|---|---|---|---|---|
| 2011/0107780 | A1 | 5/2011 | Yamaguchi et al. | |
| 2011/0174059 | A1 | 7/2011 | Yonemori et al. | |
| 2018/0180338 | A1* | 6/2018 | Honda | F25B 41/20 |

FOREIGN PATENT DOCUMENTS

| | | | |
|---|---|---|---|
| JP | 2010-107187 | A | 5/2010 |
| JP | 2012-255648-AA | | 12/2012 |
| JP | 2015-92121 | A | 5/2015 |
| JP | 2016-223640 | A | 12/2016 |
| JP | 2019-100569 | A | 6/2019 |
| WO | WO 2017/199391 | A1 | 11/2017 |

OTHER PUBLICATIONS

International Search Report (PCT/ISA/210) issued in PCT/JP2020/033810 mailed on Oct. 27, 2020.
Written Opinion (PCT/ISA/237) issued in PCT/JP2020/033810 mailed on Oct. 27, 2020.
Extended European Search Report for European Application No. 20862184.7, dated Aug. 31, 2022.

* cited by examiner

REFRIGERANT LEAKAGE DETERMINATION SYSTEM

CROSS REFERENCE TO RELATED APPLICATIONS

This application is a Continuation of PCT International Application No. PCT/JP2020/033810, filed on Sep. 7, 2020, which claims priority under 35 U.S.C. 119(a) to Patent Application No. 2019-163492, filed in Japan on Sep. 9, 2019, all of which are hereby expressly incorporated by reference into the present application.

TECHNICAL FIELD

The present disclosure relates to a refrigerant leakage determination system.

BACKGROUND ART

PTL 1 (Japanese Unexamined Patent Application Publication No. 2010-107187) discloses a leakage diagnosis apparatus that determines, by using leakage determination means, whether a refrigerant leakage has occurred in a refrigerant circuit, based on a leakage index value calculated by index value calculation means.

SUMMARY

A refrigerant leakage determination system according to a first aspect includes a refrigerant circuit, a first determination unit, and a second determination unit. The refrigerant circuit includes a compressor, a condenser, an expansion mechanism, and an evaporator. The first determination unit determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor. The second determination unit determines that refrigerant has leaked from the refrigerant circuit, based on information different from the first state amount.

DESCRIPTION OF EMBODIMENTS

A refrigerant leakage determination system according to one embodiment of the present disclosure will be described with reference to the drawings.

(1) Overall Configuration

Figure 1:
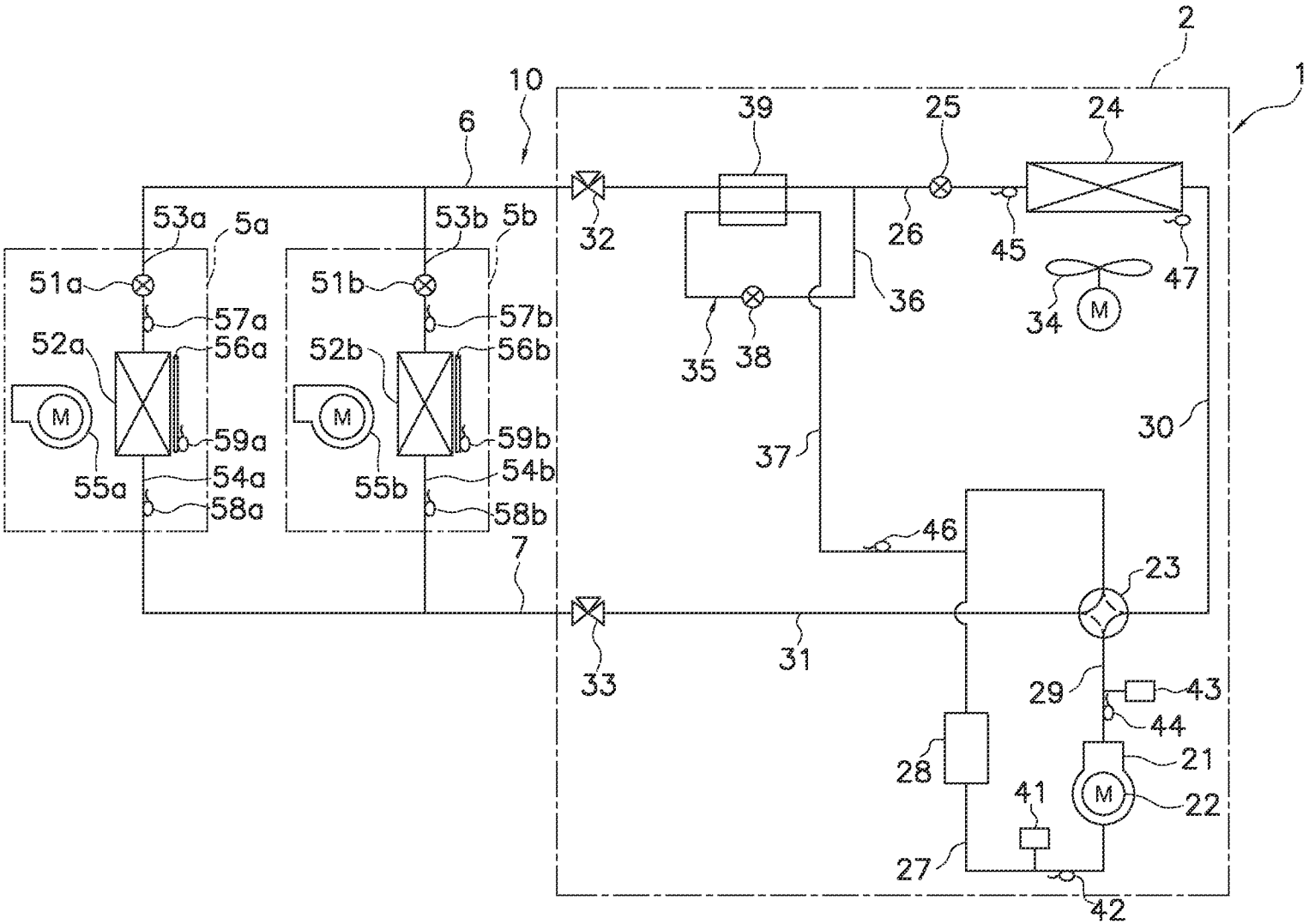
FIG. 1 is a schematic configuration diagram of a refrigerant leakage determination system according to one embodiment of the present disclosure.
Figure 2:
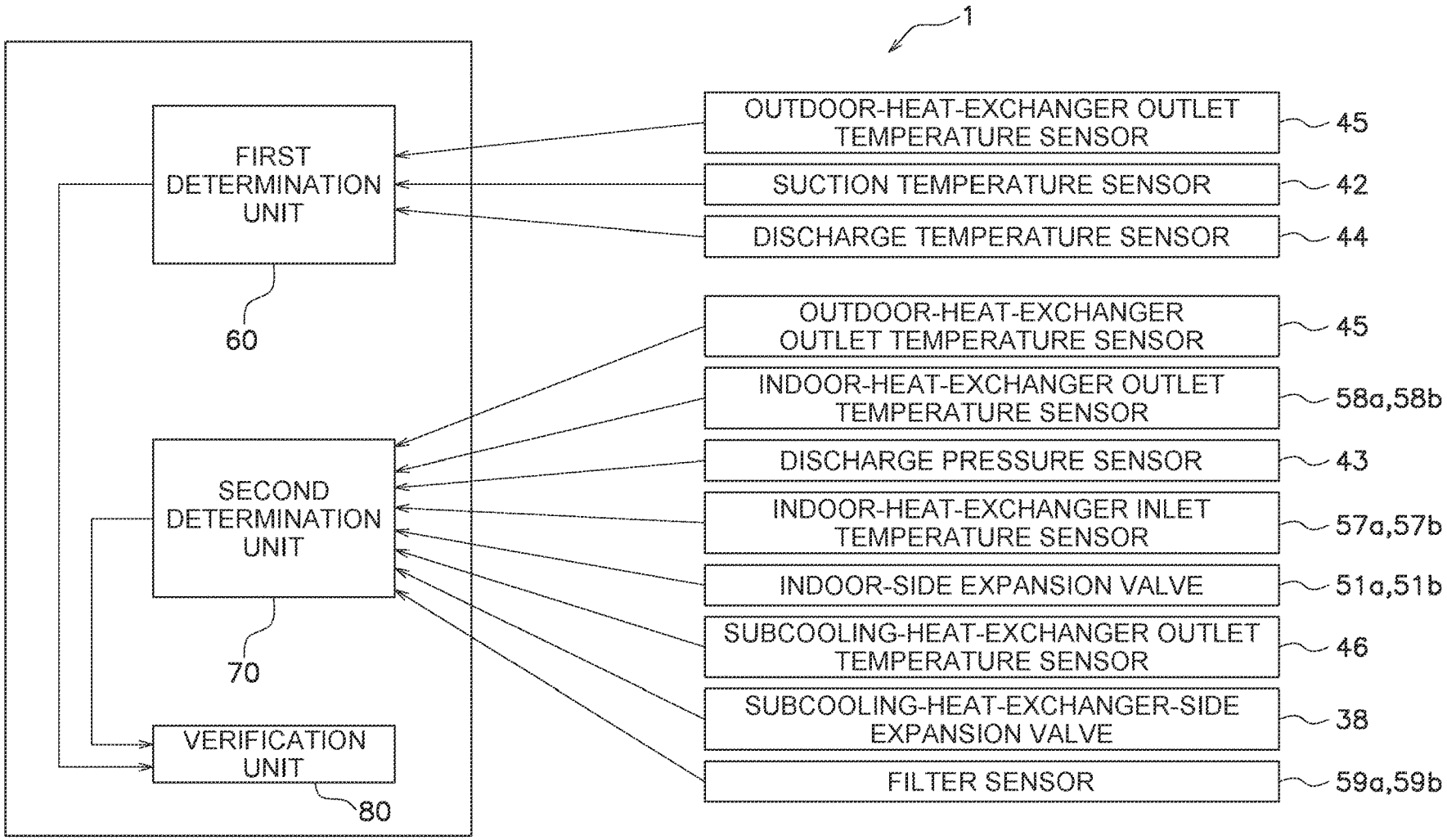
FIG. 2 is a block diagram schematically illustrating the refrigerant leakage determination system of the present disclosure.

As illustrated in FIG. 1, a refrigerant leakage determination system 1 according to one embodiment of the present disclosure is a system that determines that refrigerant has leaked from a refrigerant circuit 10. As illustrated in FIG. 1 and FIG. 2, the refrigerant leakage determination system 1 includes the refrigerant circuit 10, a first determination unit 60, a second determination unit 70, and a verification unit 80. The refrigerant circuit 10 includes a compressor 21, a condenser, an expansion mechanism, and an evaporator. The condenser corresponds to an outdoor heat exchanger 24 mounted in an outdoor unit 2 during a cooling operation, and corresponds to indoor heat exchangers 52*a* and 52*b* respectively mounted in indoor units 5*a* and 5*b* during a heating operation. The expansion mechanism includes an outdoor-side expansion valve 25, a subcooling-heat-exchanger-side expansion valve 38, and indoor-side expansion valves 51*a* and 51*b*. The evaporator corresponds to the indoor heat exchangers 52*a* and 52*b* respectively mounted in the indoor units 5*a* and 5*b* during a cooling operation, and corresponds to the outdoor heat exchanger 24 mounted in the outdoor unit 2 during a heating operation.

(2) Detailed Configuration (2-1) Air Conditioner

An air conditioner is constituted mainly by the refrigerant circuit 10. The air conditioner includes the outdoor unit 2, the plurality of indoor units 5*a* and 5*b*, a liquid-refrigerant connection pipe 6, and a gas-refrigerant connection pipe 7. In the present embodiment, the plurality of (two in FIG. 1) indoor units 5*a* and 5*b* are connected in parallel to each other. Alternatively, a single indoor unit may be provided. The liquid-refrigerant connection pipe 6 and the gas-refrigerant connection pipe 7 connect the outdoor unit 2 and the indoor units 5*a* and 5*b* to each other.

The refrigerant circuit 10 is filled with, for example, chlorofluorocarbon-based refrigerant. The refrigerant with which the refrigerant circuit 10 of the present disclosure is filled is not particularly limited.

(2-1-1) Indoor Units

The indoor units 5*a* and 5*b* are installed inside a building or the like. The indoor units 5*a* and 5*b* are connected to the outdoor unit 2 via the liquid-refrigerant connection pipe 6 and the gas-refrigerant connection pipe 7, and constitute a part of the refrigerant circuit 10.

Next, the configurations of the indoor units 5*a* and 5*b* will be described. The indoor unit 5*a* and the indoor unit 5*b* have configurations similar to each other. Thus, only the configuration of the indoor unit 5*a* will be described here. As for the configuration of the indoor unit 5*b*, a reference symbol "b" is attached instead of a reference symbol "a" indicating individual components of the indoor unit 5*a*, and a description of individual components will not be repeated.

The indoor unit 5*a* mainly includes the indoor-side expansion valve 51*a*, the indoor heat exchanger 52*a*, an indoor liquid-refrigerant pipe 53*a*, an indoor gas-refrigerant pipe 54*a*, an indoor fan 55*a*, and a filter 56*a*.

The indoor-side expansion valve 51*a* is an electric expansion valve that performs adjustment or the like of a flow rate of the refrigerant flowing through the indoor heat exchanger 52*a* and whose opening degree is adjustable. The indoor-side expansion valve 51*a* is provided in the indoor liquid-refrigerant pipe 53*a*.

The indoor heat exchanger 52*a* performs heat exchange between a refrigerant and indoor air. The indoor heat exchanger 52*a* functions as an evaporator for a refrigerant to cool indoor air during a cooling operation, and functions as a condenser for a refrigerant to heat indoor air during a heating operation.

The indoor liquid-refrigerant pipe 53*a* connects a liquid-side end of the indoor heat exchanger 52*a* and the liquid-refrigerant connection pipe 6. The indoor gas-refrigerant pipe 54*a* connects a gas-side end of the indoor heat exchanger 52*a* and the gas-refrigerant connection pipe 7.

The indoor fan 55*a* sucks indoor air into the indoor unit 5*a*, causes the indoor air to exchange heat with refrigerant in the indoor heat exchanger 52*a*, and then supplies the indoor air as supplied air into a room. The indoor fan 55*a* supplies, to the indoor heat exchanger 52*a*, indoor air serving as a heating source or cooling source of the refrigerant flowing through the indoor heat exchanger 52*a*.

The filter 56*a* is disposed upstream from the indoor heat exchanger 52*a*. The filter 56*a* traps dust in air that is prior to pass through the indoor heat exchanger 52*a*.

The indoor unit 5*a* is provided with various sensors. Specifically, the indoor unit 5*a* includes an indoor-heat-exchanger inlet temperature sensor 57*a*, an indoor-heat-exchanger outlet temperature sensor 58*a*, and a filter sensor 59*a*.

The indoor-heat-exchanger inlet temperature sensor 57*a* detects a temperature TH2 of a refrigerant at the liquid-side end of the indoor heat exchanger 52*a*. When the indoor heat exchanger 52*a* is used as an evaporator, the indoor-heat-exchanger inlet temperature sensor 57*a* serves as an evaporator inlet temperature sensor that measures an inlet temperature of the evaporator. When the indoor heat exchanger 52*a* is used as a condenser, the indoor-heat-exchanger inlet temperature sensor 57*a* serves as a condenser outlet temperature sensor that measures an outlet temperature of the condenser.

The indoor-heat-exchanger outlet temperature sensor 58*a* detects a temperature TH3 of a refrigerant at the gas-side end of the indoor heat exchanger 52*a*. When the indoor heat exchanger 52*a* is used as an evaporator, the indoor-heat-exchanger outlet temperature sensor 58*a* serves as an evaporator outlet temperature sensor that measures an outlet temperature of the evaporator. When the indoor heat exchanger 52*a* is used as a condenser, the indoor-heat-exchanger outlet temperature sensor 58*a* serves as a condenser inlet temperature sensor that measures an inlet temperature of the condenser.

The filter sensor 59*a* detects dirt of the filter 56*a*. The filter sensor 59*a* detects, for example, how much dust has been trapped in the filter 56*a*. The filter sensor 59*a* is provided in the filter 56*a*.

(2-1-2) Outdoor Unit

The outdoor unit 2 is installed outside a building or the like. The outdoor unit 2 is connected to the indoor units 5*a* and 5*b* via the liquid-refrigerant connection pipe 6 and the gas-refrigerant connection pipe 7, and constitutes a part of the refrigerant circuit 10.

Next, the configuration of the outdoor unit 2 will be described. The outdoor unit 2 mainly includes the compressor 21, a switching mechanism 23, the outdoor heat exchanger 24, the outdoor-side expansion valve 25, an outdoor liquid-refrigerant pipe 26, a suction pipe 27, an accumulator 28, a discharge pipe 29, a first outdoor gas-refrigerant pipe 30, a second outdoor gas-refrigerant pipe 31, a liquid-side shutoff valve 32, a gas-side shutoff valve 33, an outdoor fan 34, a bypass pipe 35, the subcooling-heat-exchanger-side expansion valve 38, and a subcooling heat exchanger 39.

The compressor 21 is a device that compresses low-pressure refrigerant to high-pressure refrigerant. Here, a compressor used as the compressor 21 has a hermetic structure in which a positive-displacement compression element (not illustrated), such as a rotary or scroll compression element, is driven to rotate by a compressor motor 22. Here, the number of rotations of the compressor motor 22 can be controlled by an inverter or the like, and accordingly the capacity of the compressor 21 can be controlled.

The switching mechanism 23 is a four-way switching valve capable of switching a flowing direction of the refrigerant in the refrigerant circuit 10. The switching mechanism 23 is a mechanism capable of performing switching, during a cooling operation, to cause a suction side of the compressor 21 to communicate with the gas-refrigerant connection pipe 7 through the suction pipe 27 and the second outdoor gas-refrigerant pipe 31, and cause a discharge side of the compressor 21 to communicate with a gas-side end of the outdoor heat exchanger 24 through the discharge pipe 29 and the first outdoor gas-refrigerant pipe 30. Thus, the refrigerant circuit 10 is capable of, by switching of the switching mechanism 23, performing switching to a cooling cycle state (see the solid lines in the switching mechanism 23 in FIG. 1) in which the outdoor heat exchanger 24 functions as a condenser for a refrigerant and the indoor heat exchangers 52*a* and 52*b* function as an evaporator for a refrigerant. The switching mechanism 23 is a mechanism capable of performing switching, during a heating operation, to cause the suction side of the compressor 21 to communicate with the gas-side end of the outdoor heat exchanger 24 through the suction pipe 27 and the first outdoor gas-refrigerant pipe 30, and cause the discharge side of the compressor 21 to communicate with the gas-refrigerant connection pipe 7 through the discharge pipe 29 and the second outdoor gas-refrigerant pipe 31. Thus, the refrigerant circuit 10 is capable of, by switching of the switching mechanism 23, performing switching to a heating cycle state (see the broken lines in the switching mechanism 23 in FIG. 1) in which the outdoor heat exchanger 24 functions as an evaporator for a refrigerant and the indoor heat exchangers 52*a* and 52*b* function as a condenser for a refrigerant. The switching mechanism 23 is not limited to a four-way switching valve, and may have a configuration in which a plurality of electromagnetic valves and a refrigerant pipe are combined to perform the above-described switching of a flowing direction of the refrigerant.

The outdoor heat exchanger 24 performs heat exchange between a refrigerant and outdoor air. The outdoor heat exchanger 24 functions as a condenser for a refrigerant during a cooling operation, and functions as an evaporator for a refrigerant during a heating operation. The outdoor heat exchanger 24 has a liquid-side end connected to the outdoor liquid-refrigerant pipe 26, and a gas-side end connected to the first outdoor gas-refrigerant pipe 30.

The outdoor-side expansion valve 25 is an electric expansion valve that performs adjustment or the like of a flow rate of the refrigerant flowing through the outdoor heat exchanger 24 and whose opening degree is adjustable. The outdoor-side expansion valve 25 is provided in the outdoor liquid-refrigerant pipe 26.

The outdoor liquid-refrigerant pipe 26 connects the liquid-side end of the outdoor heat exchanger 24 and the liquid-refrigerant connection pipe 6. The suction pipe 27 connects the switching mechanism 23 and the suction side of the compressor 21.

The suction pipe 27 is provided with the accumulator 28 that temporarily stores refrigerant that is to be sucked by the compressor 21. In other words, the accumulator 28 stores surplus refrigerant.

The discharge pipe 29 connects the discharge side of the compressor 21 and the switching mechanism 23. The first outdoor gas-refrigerant pipe 30 connects the switching mechanism 23 and the gas-side end of the outdoor heat exchanger 24. The second outdoor gas-refrigerant pipe 31 connects the gas-refrigerant connection pipe 7 and the switching mechanism 23. The liquid-side shutoff valve 32 is provided at a connection portion between the outdoor liquid-refrigerant pipe 26 and the liquid-refrigerant connection pipe 6. The gas-side shutoff valve 33 is provided at a connection portion between the second outdoor gas-refrigerant pipe 31 and the gas-refrigerant connection pipe 7. The liquid-side shutoff valve 32 and the gas-side shutoff valve 33 are valves that are opened or closed manually.

The outdoor fan 34 sucks outdoor air into the outdoor unit 2, causes the outdoor air to exchange heat with a refrigerant in the outdoor heat exchanger 24, and then discharges the outdoor air to the outside of the outdoor unit 2. The outdoor fan 34 supplies, to the outdoor heat exchanger 24, outdoor air serving as a cooling source or heating source of the refrigerant flowing through the outdoor heat exchanger 24.

The outdoor liquid-refrigerant pipe 26 is connected to the bypass pipe 35 and is provided with the subcooling heat exchanger 39. The bypass pipe 35 is a refrigerant pipe that causes a part of the refrigerant flowing through the outdoor liquid-refrigerant pipe 26 to branch off and return to the compressor 21. The subcooling heat exchanger 39 cools the refrigerant flowing through the outdoor liquid-refrigerant pipe 26 by using low-pressure the refrigerant flowing through the bypass pipe 35. The subcooling heat exchanger 39 is provided, in the outdoor liquid-refrigerant pipe 26, between the outdoor-side expansion valve 25 and the liquid-side shutoff valve 32.

The bypass pipe 35 connects the subcooling heat exchanger 39 and the compressor 21. The bypass pipe 35 is a refrigerant return pipe that sends the refrigerant branched from the outdoor liquid-refrigerant pipe 26 to the suction side of the compressor 21. The bypass pipe 35 includes a refrigerant return inlet pipe 36 and a refrigerant return outlet pipe 37.

The refrigerant return inlet pipe 36 is a refrigerant pipe that causes a part of the refrigerant flowing through the outdoor liquid-refrigerant pipe 26 to branch off and sends the part of the refrigerant to an inlet on the bypass pipe 35 side of the subcooling heat exchanger 39. The refrigerant return inlet pipe 36 is connected to the outdoor-side expansion valve 25 and the subcooling heat exchanger 39.

The refrigerant return inlet pipe 36 is provided with the subcooling-heat-exchanger-side expansion valve 38 that performs adjustment or the like of a flow rate of the refrigerant flowing through the bypass pipe 35. The subcooling-heat-exchanger-side expansion valve 38 decompresses the refrigerant that flows through the bypass pipe 35 and that is to enter the subcooling heat exchanger 39. The subcooling-heat-exchanger-side expansion valve 38 is an electric expansion valve.

The refrigerant return outlet pipe 37 is a refrigerant pipe that sends the refrigerant from an outlet on the bypass pipe 35 side of the subcooling heat exchanger 39 to the suction pipe 27 connected to the suction side of the compressor 21.

The bypass pipe 35 may be a refrigerant pipe that sends the refrigerant to a point in a compression process of the compressor 21, not to the suction side of the compressor 21.

The outdoor unit 2 is provided with various sensors. Specifically, the outdoor unit 2 includes a suction pressure sensor 41, a suction temperature sensor 42, a discharge pressure sensor 43, a discharge temperature sensor 44, an outdoor-heat-exchanger outlet temperature sensor 45, a subcooling-heat-exchanger outlet temperature sensor 46, and an outdoor temperature sensor 47. The suction pressure sensor 41, the suction temperature sensor 42, the discharge pressure sensor 43, and the discharge temperature sensor 44 are provided around the compressor 21 of the outdoor unit 2.

The suction pressure sensor 41 detects a suction pressure Lp of the compressor 21. The suction temperature sensor 42 detects a suction temperature Ts of the compressor 21. The discharge pressure sensor 43 detects a discharge pressure Hp of the compressor 21. The discharge temperature sensor 44 detects a discharge temperature Td of the compressor 21.

The outdoor-heat-exchanger outlet temperature sensor 45 is provided, in the outdoor liquid-refrigerant pipe 26, closer to the outdoor heat exchanger 24 than to the subcooling heat exchanger 39 (in FIG. 1, closer to the outdoor heat exchanger 24 than to the outdoor-side expansion valve 25). The outdoor-heat-exchanger outlet temperature sensor 45 detects a temperature Tb of a refrigerant at the liquid-side end of the outdoor heat exchanger 24. When the outdoor heat exchanger 24 is used as a condenser, the outdoor-heat-exchanger outlet temperature sensor 45 serves as a condenser outlet temperature sensor that measures an outlet temperature Tb of the condenser. When the outdoor heat exchanger 24 is used as an evaporator, the outdoor-heat-exchanger outlet temperature sensor 45 serves as an evaporator inlet temperature sensor that measures an inlet temperature of the evaporator.

The subcooling-heat-exchanger outlet temperature sensor 46 is provided in the refrigerant return outlet pipe 37. The subcooling-heat-exchanger outlet temperature sensor 46 measures an outlet temperature Tsh of the subcooling heat exchanger 39. Specifically, the subcooling-heat-exchanger outlet temperature sensor 46 detects a temperature Tsh of a refrigerant flowing through the outlet on the bypass pipe 35 side of the subcooling heat exchanger 39.

The outdoor temperature sensor 47 is provided around the outdoor heat exchanger 24 and the outdoor fan 34. The outdoor temperature sensor 47 measures a temperature Ta of outdoor air to be sucked into the outdoor heat exchanger 24.

(2-1-3) Refrigerant Connection Pipes

The liquid-refrigerant connection pipe 6 and the gas-refrigerant connection pipe 7 are refrigerant pipes that are installed on a site when the air conditioner including the refrigerant circuit 10 is installed in an installation place, such as a building, and the lengths or pipe diameters thereof vary according to an installation condition, such as an installation place or a combination of the outdoor unit 2 and the indoor units 5*a* and 5*b*.

The refrigerant flowing through the liquid-refrigerant connection pipe 6 may be liquid or may have two phases of gas and liquid.

(2-2) First Determination Unit

As illustrated in FIG. 2, the first determination unit 60 determines that refrigerant has leaked from the refrigerant circuit 10, by using a first state amount of refrigerant as a determination index. The first state amount includes at least an outlet temperature of a condenser, a suction temperature of the compressor 21, or a discharge temperature of the compressor 21. As the first state amount, a degree of subcooling (SC), a degree of suction superheating (suction SH), a degree of discharge superheating (DSH), and a value corresponding thereto can be used.

The degree of subcooling is a temperature difference between a condensation temperature Tc and an outlet temperature Tb of a refrigerant in the condenser, and is expressed by Tc−Tb. A value corresponding to the degree of subcooling (hereinafter also referred to as an "SC corresponding value") is, for example, (Tc−Tb)/(Tc−Ta).

The SC corresponding value herein is not limited to the value expressed by the above expression, and may be a value corrected by another parameter. For example, the SC corresponding value includes a value corrected by a frequency of the compressor, a value corrected in consideration of a physical property value, a value corrected through conversion into a Mollier diagram, and the like.

Preferably, the SC corresponding value is a value corrected by at least a temperature Ta of outdoor air. More preferably, the SC corresponding value is a value corrected by a temperature Ta of outdoor air and a condensation temperature Tc, or a value corrected by a temperature Ta of outdoor air and an outlet temperature Tb of a condenser.

The degree of suction superheating is a difference between a temperature Ts of the refrigerant sucked into the compressor 21 and an evaporation temperature Te, and is expressed by Ts−Te. A value corresponding to the degree of suction superheating (hereinafter also referred to as a "suction SH corresponding value") is, for example, (Ts−Te)/(Ta−Te).

The degree of discharge superheating is a difference between a discharge temperature Td of the compressor and a condensation temperature Tc, and is expressed by Td−Tc. A value corresponding to the degree of discharge superheating (hereinafter also referred to as a "DSH corresponding value") is, for example, (Td−Tc)/(Tc−Te).

Specifically, during a cooling operation in which the indoor heat exchangers 52*a* and 52*b* are used as an evaporator and the outdoor heat exchanger 24 is used as a condenser, at least one of an outlet temperature Tb of the condenser, a suction temperature Ts of the compressor 21, and a discharge temperature Td of the compressor is acquired from at least one of the outdoor-heat-exchanger outlet temperature sensor 45, the suction temperature sensor 42, and the discharge temperature sensor 44. Subsequently, a degree of subcooling or an SC corresponding value is calculated as the first state amount from the outlet temperature Tb of a refrigerant in the condenser. Alternatively, a degree of suction superheating or a suction SH corresponding value is calculated as the first state amount from the temperature Ts of the refrigerant sucked into the compressor 21. Alternatively, a degree of discharge superheating or a DSH corresponding value is calculated as the first state amount from the discharge temperature Td of the compressor 21. Subsequently, the first determination unit 60 determines whether refrigerant has leaked in the refrigerant circuit 10, by using the first state amount and a value of a reference state (reference value) in which a refrigerant leakage has not occurred in the refrigerant circuit 10.

In the present embodiment, the first determination unit 60 uses, as the first state amount, a degree of subcooling or an SC corresponding value. In this case, the first determination unit 60 calculates a condensation temperature Tc from a discharge pressure Hp of the discharge pressure sensor 43. Also, the first determination unit 60 acquires an outlet temperature Tb of the condenser from the condenser outlet temperature sensor. Subsequently, the first determination unit 60 calculates, as the first state amount, a degree of subcooling or an SC corresponding value from the condensation temperature Tc and the outlet temperature Tb. Furthermore, the first determination unit 60 acquires a reference value of the degree of subcooling or the SC corresponding value. The reference value is estimated based on, for example, an outdoor temperature, the number of rotations of the compressor, a current value, or the like. If the difference between the calculated degree of subcooling or SC corresponding value and the estimated reference value is larger than a predetermined value, the first determination unit 60 determines that refrigerant has leaked. On the other hand, if the difference between the calculated degree of subcooling or SC corresponding value and the reference value is smaller than or equal to the predetermined value, the first determination unit 60 determines that refrigerant has not leaked.

At least one of the first determination unit 60 and the second determination unit 70 described below is stored in an external apparatus. The external apparatus is an apparatus outside the air conditioner mainly including the refrigerant circuit 10. Specifically, the external apparatus is outside the apparatus constituted by the outdoor unit 2, the indoor units 5*a* and 5*b*, the liquid-refrigerant connection pipe 6, and the gas-refrigerant connection pipe 7. The external apparatus of the present embodiment is a cloud server. In this case, information on each sensor and each expansion valve is accumulated in the cloud server.

(2-3) Second Determination Unit and Verification Unit

The second determination unit 70 determines that refrigerant has leaked from the refrigerant circuit 10, based on information different from the first state amount. Here, as illustrated in FIG. 2, the second determination unit 70 acquires information from at least one of the outdoor-heat-exchanger outlet temperature sensor 45, the indoor-heat-exchanger outlet temperature sensors 58*a* and 58*b*, the discharge pressure sensor 43, the indoor-heat-exchanger inlet temperature sensors 57*a* and 57*b*, the indoor-side expansion valves 51*a* and 51*b*, the subcooling-heat-exchanger outlet temperature sensor 46, the subcooling-heat-exchanger-side expansion valve 38, and the filter sensors 59*a* and 59*b*. The second determination unit 70 may determine, by using acquired information, whether refrigerant has leaked, whether the various sensors or valves have broken down, or whether a wet operation described below is being performed in which the degree of discharge superheating or the DSH corresponding value is smaller than or equal to a normal value.

The verification unit 80 verifies whether refrigerant has leaked from the refrigerant circuit 10, based on a determination result of the first determination unit 60 and a determination result of the second determination unit 70. The verification unit 80 outputs a verification result as a determination result of the refrigerant leakage determination system 1. In the present embodiment, the verification unit 80 verifies the determination result of the first determination unit 60 by using the determination result of the second determination unit 70.

(2-3-1) First Method

Figure 3:
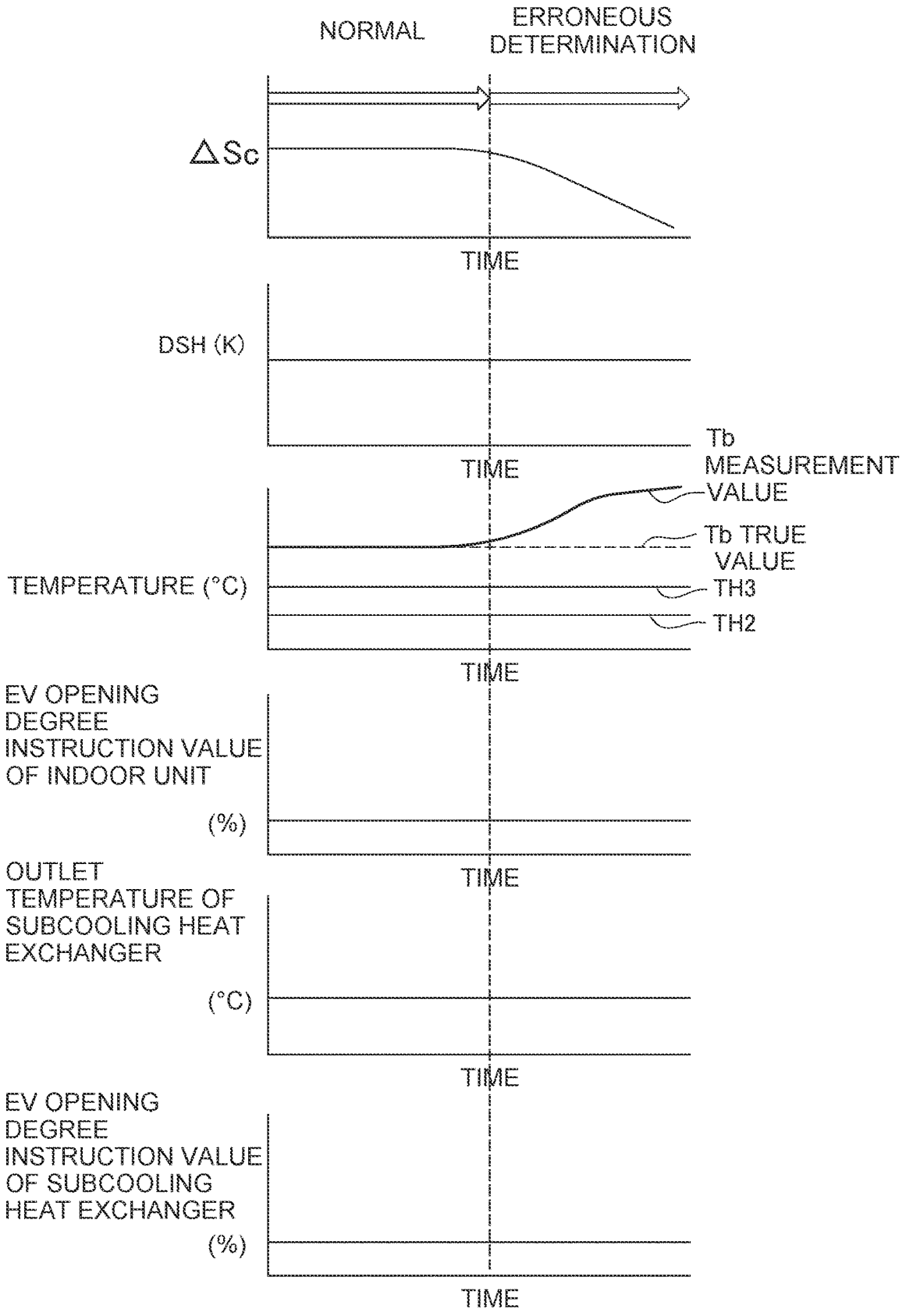
FIG. 3 is a diagram schematically illustrating an example of behaviors of various parameters of the present disclosure.

With reference to FIG. 1 to FIG. 3, a determination method of the second determination unit 70 and a verification method of the verification unit 80 will be described by using examples. In the following description, individual sensors during a cooling operation in which the indoor heat exchangers 52*a* and 52*b* are used as an evaporator and the outdoor heat exchanger 24 is used as a condenser will be put in parentheses. FIG. 3 schematically illustrates an example of behaviors of various parameters in a case where the first determination unit 60 determines that refrigerant has leaked and the second determination unit 70 determines that refrigerant has not leaked. In FIG. 3, the vertical axis represents ΔSc, which is a difference between a degree of subcooling and a reference value; a degree of discharge superheating; a measurement value and a true value of an outlet temperature Tb of the condenser; an inlet temperature TH2 of the evaporator; an outlet temperature TH3 of the evaporator; opening degree instruction values of the indoor-side expansion valves 51*a* and 51*b*; an outlet temperature Tsh of the subcooling heat exchanger 39; and an opening degree instruction value of the subcooling-heat-exchanger-side expansion valve 38, and the horizontal axis represents elapsed time.

In a first method, the second determination unit 70 detects, by using a value of a condenser outlet temperature sensor (outdoor-heat-exchanger outlet temperature sensor 45), whether the condenser outlet temperature sensor has a failure, thereby determining that refrigerant has leaked. As illustrated in FIG. 3, when the condenser outlet temperature sensor has a failure and a value of the outlet temperature Tb of the condenser greater than a true value is output, a degree of subcooling and an SC corresponding value that are calculated are smaller than a reference value. If ΔSc, which is the difference between the degree of subcooling or the SC corresponding value and the reference value is greater than a predetermined value, the first determination unit 60 determines that refrigerant has leaked. In contrast to this, the second determination unit 70 determines that refrigerant has not leaked, in response to detecting that the condenser outlet temperature sensor has a failure. The verification unit 80 that has received determination results of the first determination unit 60 and the second determination unit 70 determines that the determination result of the first determination unit 60 is wrong and determines that refrigerant has not leaked. On the other hand, the second determination unit 70 determines that refrigerant has leaked, in response to detecting that the condenser outlet temperature sensor does not have a failure. The verification unit 80 determines that the determination result of the first determination unit 60 is correct and determines that refrigerant has leaked.

Figure 4:
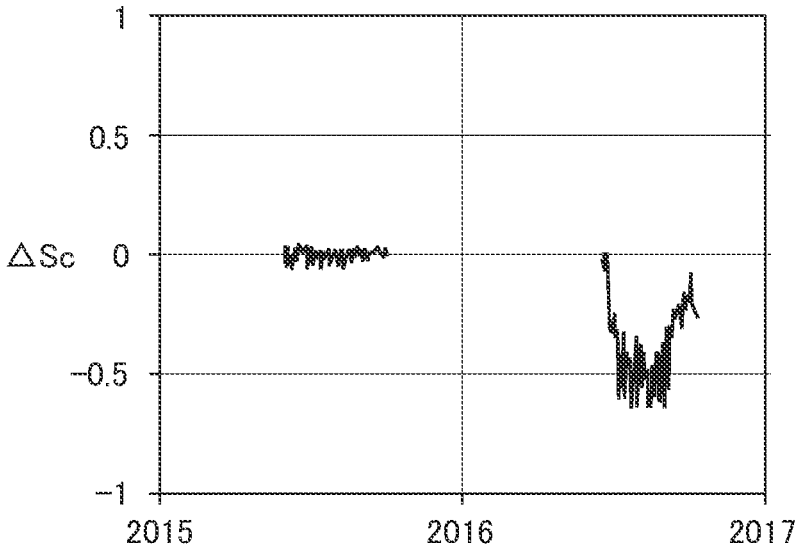
FIG. 4 is a diagram illustrating a difference ΔSc between a degree of subcooling and a reference value of one air conditioner.
Figure 5:
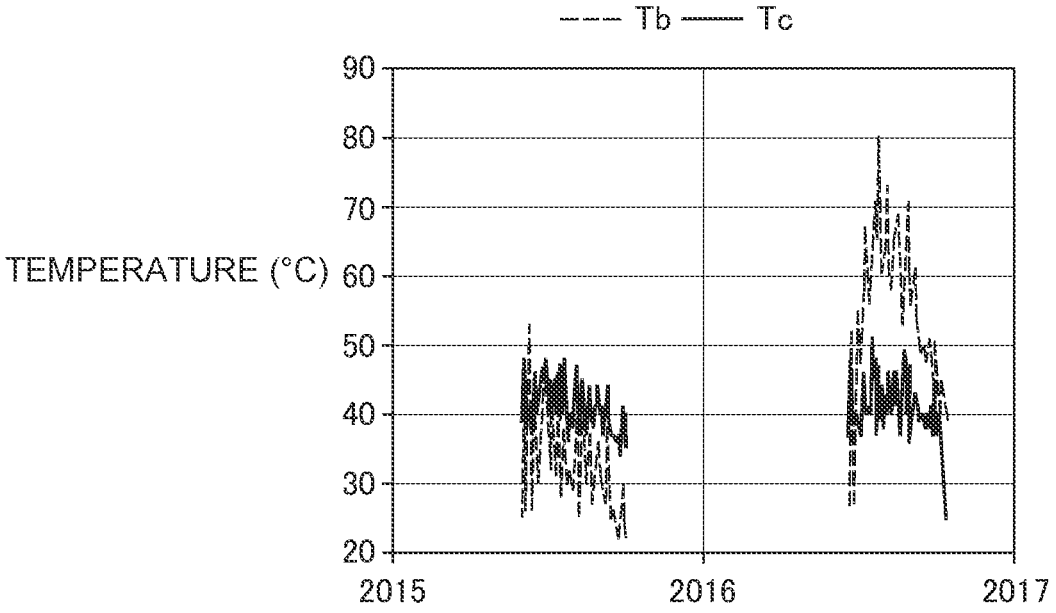
FIG. 5 illustrates an outlet temperature Tb and a condensation temperature Tc of a condenser of one air conditioner.

Now, a description will be given by using specific examples illustrated in FIG. 4 and FIG. 5. FIG. 4 illustrates ΔSc, which is a difference between a degree of subcooling and a reference value of one air conditioner in the years 2015 and 2016. In FIG. 4, the vertical axis represents the difference between the degree of subcooling and the reference value, and the horizontal axis represents the time of measurement. FIG. 5 illustrates an outlet temperature Tb of the condenser in the same air conditioner as in FIG. 4, and a condensation temperature Tc calculated from a discharge pressure Hp of the discharge pressure sensor 43. In FIG. 5, the vertical axis represents the outlet temperature Tb and the condensation temperature Tc of the condenser, and the horizontal axis represents the time of measurement.

As illustrated in FIG. 4, in the year 2016, there is a time in which ΔSc, which is the difference between the degree of subcooling and the reference value, significantly decreases. In this time, the amount of decrease in ΔSc exceeds a predetermined value, and thus the first determination unit 60 determines that refrigerant has leaked. Actually, however, the condenser outlet temperature sensor has a failure and thus an outlet temperature Tb that is very higher than a true value is output, as illustrated in FIG. 5. In response to detecting that the condenser outlet temperature sensor has a failure, the second determination unit 70 determines that refrigerant has not leaked. The verification unit 80 that has received determination results of the first determination unit 60 and the second determination unit 70 determines that the determination result of the first determination unit 60 is wrong and determines that refrigerant has not leaked from the refrigerant circuit 10.

(2-3-2) Second Method

In a second method, the second determination unit 70 detects, by using a value of the discharge pressure sensor 43, whether the discharge pressure sensor 43 has a failure, thereby determining that refrigerant has leaked. When the discharge pressure sensor 43 has a failure and outputs a value of the discharge pressure Hp of the compressor 21 smaller than a true value, a condensation temperature Tc that is calculated decreases in the first determination unit 60, and thus the degree of subcooling and the SC corresponding value are smaller than the reference value. When the difference between the degree of subcooling and the reference value, and the difference between the SC corresponding value and the reference value, are greater than a predetermined value, the first determination unit 60 determines that refrigerant has leaked. In contrast to this, the second determination unit 70 determines that refrigerant has not leaked, in response to detecting that the discharge pressure sensor 43 has a failure. In this case, the verification unit 80 determines that the determination result of the first determination unit 60 is wrong and determines that refrigerant has not leaked from the refrigerant circuit 10. On the other hand, if the second determination unit 70 detects that the discharge pressure sensor 43 does not have a failure, the verification unit 80 determines that refrigerant has leaked. In this case, the verification unit 80 determines that the determination result of the first determination unit 60 is correct and determines that refrigerant has leaked from the refrigerant circuit 10.

(2-3-3) Third Method

In a third method, the second determination unit 70 detects, based on a degree of discharge superheating or a DSH corresponding value, whether refrigerant remains inside the accumulator 28, thereby determining that refrigerant has leaked. Here, the second determination unit 70 detects whether a wet operation is being performed in which the degree of discharge superheating or the DSH corresponding value is smaller than or equal to a normal value, and detects whether an erroneous determination has been made due to refrigerant remaining inside the accumulator 28 because of a wet operation.

Specifically, a decrease in the inlet temperature TH2 of the evaporator output from the evaporator inlet temperature sensor (indoor-heat-exchanger inlet temperature sensors 57*a* and 57*b*) or an increase in the outlet temperature TH3 of the evaporator output from the evaporator outlet temperature sensor (indoor-heat-exchanger outlet temperature sensors 58*a* and 58*b*) causes the degree of superheating at the evaporator outlet to be higher than a reference value. Accordingly, to overcome excessive superheating, the opening degrees of the indoor-side expansion valves 51*a* and 51*b* are wrongly controlled to be increased. As a result, a circulation amount of refrigerant increases, and refrigerant that failed to evaporate remains inside the accumulator 28. Because the circulation amount of refrigerant in the refrigerant circuit 10 decreases, the first determination unit 60 determines that refrigerant has leaked. At this time, the wetness of the refrigerant sucked by the compressor 21 is high. Thus, a wet operation is performed, and the degree of discharge superheating or the DSH corresponding value decreases. In contrast to this, the second determination unit 70 detects, based on the degree of discharge superheating or the DSH corresponding value, the refrigerant remaining inside the accumulator 28, and utilizes the detection for determination.

Specifically, in response to detecting that the refrigerant remaining inside the accumulator 28 is a predetermined value or more based on the degree of discharge superheating or the DSH corresponding value, the second determination unit 70 determines that refrigerant has not leaked. In this case, the verification unit 80 determines that the determination result of the first determination unit 60 is wrong and determines that refrigerant has not leaked. On the other hand, in response to detecting that the refrigerant remaining inside the accumulator 28 is less than the predetermined value based on the degree of discharge superheating or the DSH corresponding value, the second determination unit 70 determines that refrigerant has leaked. In this case, the verification unit 80 determines that the determination result of the first determination unit 60 is correct and determines that refrigerant has leaked from the refrigerant circuit 10.

Here, when the degree of discharge superheating or the DSH corresponding value is smaller than or equal to a threshold value, the second determination unit 70 determines that a wet operation is being performed and refrigerant has not leaked. The threshold value is, for example, 20° C., and is preferably 15° C. As described above, in the third method, attention is focused on that the degree of discharge superheating or the DSH corresponding value decreases resulting from a wet state, and the second determination unit 70 detects a state in which the degree of discharge superheating or the DSH corresponding value is lower than a normal value.

(2-3-4) Fourth Method

In a fourth method, the second determination unit 70 detects, by using a value of an evaporator inlet temperature sensor (indoor-heat-exchanger inlet temperature sensors 57*a* and 57*b*), whether the evaporator inlet temperature sensor has a failure, thereby determining that refrigerant has leaked. When the evaporator inlet temperature sensor has a failure and outputs a value of the inlet temperature TH2 of the evaporator smaller than a true value, the degree of superheating at the evaporator outlet becomes higher than a reference value. Accordingly, to overcome excessive superheating, the opening degree of the indoor-side expansion valve is wrongly controlled to be increased. As a result, a circulation amount of refrigerant increases, and refrigerant that failed to evaporate remains inside the accumulator 28. Because the circulation amount of refrigerant in the refrigerant circuit 10 decreases, the first determination unit 60 determines that refrigerant has leaked. In contrast to this, the second determination unit 70 determines that refrigerant has not leaked, in response to detecting that the evaporator inlet temperature sensor has a failure. In this case, the verification unit 80 that has received determination results of the first determination unit 60 and the second determination unit 70 determines that the determination result of the first determination unit 60 is wrong and determines that refrigerant has not leaked. On the other hand, the second determination unit 70 determines that refrigerant has leaked, in response to detecting that the evaporator inlet temperature sensor does not have a failure. In this case, the verification unit 80 determines that the determination result of the first determination unit 60 is correct and determines that refrigerant has leaked from the refrigerant circuit 10.

(2-3-5) Fifth Method

In a fifth method, the second determination unit 70 detects, by using a value of an evaporator outlet temperature sensor (indoor-heat-exchanger outlet temperature sensors 58*a* and 58*b*), whether the evaporator outlet temperature sensor has a failure, thereby determining that refrigerant has leaked. When the evaporator outlet temperature sensor has a failure and outputs a value of the outlet temperature TH3 of the evaporator greater than a true value, the degree of superheating at the evaporator outlet becomes higher than a reference value. Accordingly, to overcome excessive superheating, the opening degree of the indoor-side expansion valve is wrongly controlled to be increased. As a result, a circulation amount of refrigerant increases, and refrigerant that failed to evaporate remains inside the accumulator 28. Because the circulation amount of refrigerant in the refrigerant circuit 10 decreases, the first determination unit 60 determines that refrigerant has leaked. In contrast to this, the second determination unit 70 determines that refrigerant has not leaked, in response to detecting that the evaporator outlet temperature sensor has a failure. In this case, the verification unit 80 determines that the determination result of the first determination unit 60 is wrong and determines that refrigerant has not leaked. On the other hand, the second determination unit 70 determines that refrigerant has leaked, in response to detecting that the evaporator outlet temperature sensor does not have a failure. In this case, the verification unit 80 determines that the determination result of the first determination unit 60 is correct and determines that refrigerant has leaked from the refrigerant circuit 10.

In association with the fourth and fifth methods, the second determination unit 70 detects, by using a value of the evaporator inlet temperature sensor (indoor-heat-exchanger inlet temperature sensors 57*a* and 57*b*), whether the evaporator outlet temperature sensor (indoor-heat-exchanger outlet temperature sensors 58*a* and 58*b*) has a failure, thereby determining that refrigerant has leaked. In addition, the second determination unit 70 detects, by using a value of the evaporator outlet temperature sensor (indoor-heat-exchanger outlet temperature sensors 58*a* and 58*b*), whether the evaporator inlet temperature sensor (indoor-heat-exchanger inlet temperature sensors 57*a* and 57*b*) has a failure. In addition, the second determination unit 70 detects, by using values of the evaporator inlet temperature sensor (indoor-heat-exchanger inlet temperature sensors 57*a* and 57*b*) and the evaporator outlet temperature sensor (indoor-heat-exchanger outlet temperature sensors 58*a* and 58*b*), whether the evaporator inlet temperature sensor (indoor-heat-exchanger inlet temperature sensors 57*a* and 57*b*) and the evaporator outlet temperature sensor (indoor-heat-exchanger outlet temperature sensors 58*a* and 58*b*) have a failure.

When the value of the evaporator inlet temperature sensor (indoor-heat-exchanger inlet temperature sensors 57*a* and 57*b*) decreases or the value of the evaporator outlet temperature sensor (indoor-heat-exchanger outlet temperature sensors 58*a* and 58*b*) increases due to a failure of the sensor, refrigerant remains inside the accumulator 28. Thus, for example, when the evaporator outlet temperature sensor has a higher failure occurrence rate than the evaporator inlet temperature sensor, the second determination unit 70 may detect at least whether the evaporator outlet temperature sensor has a failure by using a value of the evaporator inlet temperature sensor and/or the evaporator outlet temperature sensor.

(2-3-6) Sixth Method

In a sixth method, the second determination unit 70 detects, by using a degree of superheating at the outlet of the indoor heat exchanger, which is a difference between outlet temperatures of the indoor heat exchangers 52*a* and 52*b* and evaporation temperatures of the refrigerant in the indoor heat exchangers 52*a* and 52*b*, and values of the opening degrees of the indoor-side expansion valves 51*a* and 51*b*, whether the indoor-side expansion valves 51*a* and 51*b* have a failure, thereby determining that refrigerant has leaked. When a failure in the indoor-side expansion valves 51*a* and 51*b* causes the opening degrees thereof to be fixed in a large value or causes actual opening degrees to be higher than an opening degree instruction value, excessive the refrigerant flows into the indoor heat exchangers 52*a* and 52*b* and the outlets thereof become wet. Thus, refrigerant remains inside the accumulator 28, and the circulation amount of refrigerant in the refrigerant circuit 10 decreases. Thus, the first determination unit 60 determines that refrigerant has leaked. At this time, a degree of superheating is not obtained at the outlet of the indoor heat exchanger, and control is performed to close the indoor-side expansion valves 51*a* and 51*b*. Thus, the opening degree instruction value thereof becomes minimum. In contrast to this, the second determination unit 70 detects whether the indoor-side expansion valves 51*a* and 51*b* have a failure, by using the degree of superheating at the outlet of the indoor heat exchanger and the opening degree instruction value of the indoor-side expansion valves 51*a* and 51*b*. In response to detecting that the indoor-side expansion valves 51*a* and 51*b* have a failure, the second determination unit 70 determines that refrigerant has not leaked. In this case, the verification unit 80 determines that the determination result of the first determination unit 60 is wrong and determines that refrigerant has not leaked. On the other hand, in response to detecting that the indoor-side expansion valves 51*a* and 51*b* do not have a failure, the second determination unit 70 determines that refrigerant has leaked. In this case, the verification unit 80 determines that the determination result of the first determination unit 60 is correct and determines that refrigerant has leaked from the refrigerant circuit 10.

(2-3-7) Seventh Method

In a seventh method, the second determination unit 70 determines that refrigerant has leaked, based on a state amount of refrigerant that passes through the subcooling heat exchanger 39. When the value of the outlet temperature Tsh of the subcooling heat exchanger output as a result of a failure in the subcooling-heat-exchanger outlet temperature sensor 46 increases, the opening degree of the subcooling-heat-exchanger-side expansion valve 38 is controlled to increase. Otherwise, a mechanical failure may occur in the subcooling-heat-exchanger-side expansion valve 38, and the opening degree of the subcooling-heat-exchanger-side expansion valve 38 may be fixed to a large value. As a result of the above, refrigerant remains inside the accumulator 28 and the circulation amount of refrigerant in the refrigerant circuit 10 decreases. Thus, the first determination unit 60 determines that refrigerant has leaked. At this time, the wetness of the refrigerant sucked by the compressor 21 is high. Thus, a wet operation is performed, and the degree of discharge superheating or the DSH corresponding value decreases. In contrast to this, the second determination unit 70 makes a determination by using a state amount of refrigerant in the subcooling heat exchanger 39. Specifically, when a difference between the state amount of the refrigerant that passes through the subcooling heat exchanger 39 and a predetermined value is outside an allowable range, the second determination unit 70 determines that refrigerant has not leaked. In this case, the verification unit 80 determines that the determination result of the first determination unit 60 is wrong and determines that refrigerant has not leaked. On the other hand, when the difference between the state amount of the refrigerant that passes through the subcooling heat exchanger 39 and the predetermined value is within the allowable range, the second determination unit 70 determines that refrigerant has leaked. In this case, the verification unit 80 determines that the determination result of the first determination unit 60 is correct and determines that refrigerant has leaked from the refrigerant circuit 10.

In association with the seventh method, the second determination unit 70 detects, by using a value of the subcooling-heat-exchanger outlet temperature sensor 46, whether the subcooling-heat-exchanger outlet temperature sensor 46 has a failure, thereby determining that refrigerant has leaked. When the subcooling-heat-exchanger outlet temperature sensor 46 has a failure and outputs a value of the outlet temperature Tsh of the subcooling heat exchanger greater than a true value, the opening degree of the subcooling-heat-exchanger-side expansion valve 38 is controlled to increase, refrigerant remains inside the accumulator 28, and the circulation amount of refrigerant in the refrigerant circuit 10 decreases. Thus, the first determination unit 60 determines that refrigerant has leaked. In contrast to this, the second determination unit 70 determines that refrigerant has not leaked, in response to detecting that the subcooling-heat-exchanger outlet temperature sensor 46 has a failure. In this case, the verification unit 80 determines that the determination result of the first determination unit 60 is wrong and determines that refrigerant has not leaked. On the other hand, the second determination unit 70 determines that refrigerant has leaked, in response to detecting that the subcooling-heat-exchanger outlet temperature sensor 46 does not have a failure. In this case, the verification unit 80 determines that the determination result of the first determination unit 60 is correct and determines that refrigerant has leaked from the refrigerant circuit 10.

In association with the seventh method, the second determination unit 70 detects, by using either an outlet temperature of the subcooling heat exchanger 39 or a degree of superheating at the outlet of the subcooling heat exchanger, which is a difference between the outlet temperature of the subcooling heat exchanger 39 and an evaporation temperature of the refrigerant in the subcooling heat exchanger 39, and also using the opening degree of the subcooling-heat-exchanger-side expansion valve 38, whether the subcooling-heat-exchanger-side expansion valve 38 has a failure, thereby determining that refrigerant has leaked. When the subcooling-heat-exchanger-side expansion valve 38 has a failure and a large value of the opening degree is output, refrigerant remains inside the accumulator 28 and the circulation amount of refrigerant in the refrigerant circuit 10 decreases. Thus, the first determination unit 60 determines that refrigerant has leaked. In contrast to this, the second determination unit 70 detects whether the indoor-side expansion valves 51*a* and 51*b* have a failure, by using (a degree of superheating at the outlet of the subcooling heat exchanger or a value of the subcooling-heat-exchanger outlet temperature sensor 64), and (the opening degree of the subcooling-heat-exchanger-side expansion valve 38). In response to detecting that the subcooling-heat-exchanger-side expansion valve 38 has a failure, the second determination unit 70 determines that refrigerant has not leaked. In this case, the verification unit 80 determines that the determination result of the first determination unit 60 is wrong and determines that refrigerant has not leaked. On the other hand, in response to detecting that the subcooling-heat-exchanger-side expansion valve 38 does not have a failure, the second determination unit 70 determines that refrigerant has leaked. In this case, the verification unit 80 determines that the determination result of the first determination unit 60 is correct and determines that refrigerant has leaked from the refrigerant circuit 10.

Whether the condenser outlet temperature sensor, the discharge pressure sensor 43, the evaporator inlet temperature sensor, the evaporator outlet temperature sensor, the indoor-side expansion valves 51*a* and 51*b*, the subcooling-heat-exchanger outlet temperature sensor 46, and the subcooling-heat-exchanger-side expansion valve 38 have a failure is detected in a generally known method by using values of the individual sensors and values of opening degrees of the individual expansion valves. For example, whether a failure has occurred can be detected by estimating normal values from a plurality of pieces of normal data of the individual sensors and the individual expansion valves and comparing the normal values with current values.

(2-3-8) Eighth Method

In an eighth method, the second determination unit 70 detects dirt of the filters 56*a* and 56*b* that trap dust in air that is prior to pass through an evaporator (indoor heat exchangers 52*a* and 52*b*), thereby determining that refrigerant has leaked. When the degree of dirt of the filters 56*a* and 56*b* of the indoor heat exchangers 52*a* and 52*b* increases, heat exchange capacity decreases, a large amount of liquid refrigerant is accumulated in the indoor heat exchangers 52*a* and 52*b*, and liquid refrigerant that has failed to evaporate in the indoor heat exchangers 52*a* and 52*b* remains inside the accumulator 28. Accordingly, the circulation amount of refrigerant in the refrigerant circuit 10 decreases, and thus the first determination unit 60 determines that refrigerant has leaked. At this time, the wetness of the refrigerant sucked by the compressor 21 is high. Thus, a wet operation is performed, and the degree of discharge superheating or the DSH corresponding value decreases. In contrast to this, the second determination unit 70 determines that refrigerant has not leaked, in response to detecting that the degree of dirt of the filters 56*a* and 56*b* is high and is outside an allowable range. In this case, the verification unit 80 determines that the determination result of the first determination unit 60 is wrong and determines that refrigerant has not leaked. On the other hand, the second determination unit 70 determines that refrigerant has leaked, in response to detecting that the degree of dirt of the filters 56*a* and 56*b* is low and is within the allowable range. In this case, the verification unit 80 determines that the determination result of the first determination unit 60 is correct and determines that refrigerant has leaked from the refrigerant circuit 10.

(3) Operation

The refrigerant leakage determination system 1 executes, by using the refrigerant circuit 10, a heating operation and a cooling operation.

(3-1) Cooling Operation

A cooling operation will be described with reference to FIG. 1. In a cooling operation, an operation frequency of the compressor 21 is controlled so that a value of low pressure of a refrigeration cycle (a detection value of the suction pressure sensor 41) is a constant value, and the opening degrees of the indoor-side expansion valves 51*a* and 51*b* are adjusted so that the degree of superheating of the refrigerant is a predetermined target value (for example, 5° C.) at the outlets of the indoor heat exchangers 52*a* and 52*b*.

In response to an instruction of a cooling operation provided by input from a remote controller (not illustrated) or the like, the switching mechanism 23 is switched to bring the refrigerant circuit 10 into a cooling cycle state (the state indicated by the solid lines of the switching mechanism 23 in FIG. 1). Accordingly, the compressor 21, the outdoor fan 34, and the indoor fans 55*a* and 55*b* are activated, and the outdoor-side expansion valve 25, the subcooling-heat-exchanger-side expansion valve 38, the indoor-side expansion valves 51*a* and 51*b*, and so forth perform predetermined operations.

Accordingly, low-pressure gas refrigerant in the refrigerant circuit 10 is sucked and compressed by the compressor 21 and becomes high-pressure gas refrigerant. The high-pressure gas refrigerant is sent to the outdoor heat exchanger 24 through the switching mechanism 23.

In the outdoor heat exchanger 24 functioning as a condenser for the refrigerant, the high-pressure gas refrigerant sent to the outdoor heat exchanger 24 exchanges heat with outdoor air supplied by the outdoor fan 34 so as to be cooled and condensed, and becomes high-pressure liquid refrigerant. The high-pressure liquid refrigerant is sent to the subcooling heat exchanger 39 through the outdoor-side expansion valve 25.

At this time, a part of the high-pressure liquid refrigerant flowing through the outdoor liquid-refrigerant pipe 26 branches into the bypass pipe 35 and is decompressed by the subcooling-heat-exchanger-side expansion valve 38. The refrigerant decompressed by the subcooling-heat-exchanger-side expansion valve 38 is sent to the subcooling heat exchanger 39, exchanges heat with the high-pressure liquid refrigerant flowing through the outdoor liquid-refrigerant pipe 26 so as to be heated and evaporated, becomes gas refrigerant, and is returned to the compressor 21.

The high-pressure liquid refrigerant sent to the subcooling heat exchanger 39 exchanges heat with the refrigerant flowing through the bypass pipe 35 so as to be further cooled, and is sent from the outdoor unit 2 to the indoor units 5*a* and 5*b* through the liquid-side shutoff valve 32 and the liquid-refrigerant connection pipe 6.

The high-pressure liquid refrigerant sent to the indoor units 5*a* and 5*b* is decompressed by the indoor-side expansion valves 51*a* and 51*b* and becomes low-pressure refrigerant in a gas-liquid two-phase state. The low-pressure refrigerant in a gas-liquid two-phase state is sent to the indoor heat exchangers 52*a* and 52*b*.

In the indoor heat exchangers 52*a* and 52*b* functioning as an evaporator for refrigerant, the low-pressure refrigerant in a gas-liquid two-phase state sent to the indoor heat exchangers 52*a* and 52*b* exchanges heat with indoor air supplied by the indoor fans 55*a* and 55*b* so as to be heated and evaporated, and becomes low-pressure gas refrigerant. The low-pressure gas refrigerant is sent from the indoor units 5*a* and 5*b* to the outdoor unit 2 through the gas-refrigerant connection pipe 7.

The low-pressure gas refrigerant sent to the outdoor unit 2 is sucked by the compressor 21 again through the gas-side shutoff valve 33 and the switching mechanism 23.

(3-2) Heating Operation

A heating operation will be described with reference to FIG. 1. In a heating operation, an operation frequency of the compressor 21 is controlled so that a value of high pressure of a refrigeration cycle (a detection value of the discharge pressure sensor 43) is a constant value, and the opening degrees of the expansion valves are adjusted so that the degree of subcooling of a refrigerant is a predetermined target value (for example, 5 K) at the outlets of the indoor heat exchangers 52*a* and 52*b*.

In response to an instruction of a heating operation provided by input from a remote controller (not illustrated) or the like, the switching mechanism 23 is switched to bring the refrigerant circuit 10 into a heating cycle state (the state indicated by the broken lines of the switching mechanism 23 in FIG. 1). The compressor 21, the outdoor fan 34, and the indoor fans 55*a* and 55*b* are activated, and the outdoor-side expansion valve 25, the subcooling-heat-exchanger-side expansion valve 38, the indoor-side expansion valves 51*a* and 51*b*, and so forth perform predetermined operations.

Accordingly, low-pressure gas refrigerant in the refrigerant circuit 10 is sucked and compressed by the compressor 21 and becomes high-pressure gas refrigerant. The high-pressure gas refrigerant is sent from the outdoor unit 2 to the indoor units 5*a* and 5*b* through the switching mechanism 23, the gas-side shutoff valve 33, and the gas-refrigerant connection pipe 7. The high-pressure gas refrigerant sent to the indoor units 5*a* and 5*b* is sent to the indoor heat exchangers 52*a* and 52*b*.

In the indoor heat exchangers 52*a* and 52*b* functioning as a condenser for refrigerant, the high-pressure gas refrigerant sent to the indoor heat exchangers 52*a* and 52*b* exchanges heat with indoor air supplied by the indoor fans 55*a* and 55*b* so as to be cooled and condensed, and becomes high-pressure liquid refrigerant. The high-pressure liquid refrigerant is sent from the indoor units 5*a* and 5*b* to the outdoor unit 2 through the indoor-side expansion valves 51*a* and 51*b* and the liquid-refrigerant connection pipe 6.

The refrigerant sent to the outdoor unit 2 is sent to the outdoor-side expansion valve 25 through the liquid-side shutoff valve 32 and the subcooling heat exchanger 39, and is decompressed by the outdoor-side expansion valve 25 so as to become low-pressure refrigerant in a gas-liquid two-phase state. The low-pressure refrigerant in a gas-liquid two-phase state is sent to the outdoor heat exchanger 24.

In the outdoor heat exchanger 24 functioning as an evaporator for a refrigerant, the low-pressure refrigerant in a gas-liquid two-phase state sent to the outdoor heat exchanger 24 exchanges heat with outdoor air supplied by the outdoor fan 34 so as to be heated and evaporated, and becomes low-pressure gas refrigerant. The low-pressure gas refrigerant is sucked by the compressor 21 again through the switching mechanism 23.

(4) Refrigerant Leakage Determination Method

A refrigerant leakage determination method according to one embodiment of the present disclosure will be described with reference to FIG. 1 to FIG. 7. The refrigerant leakage determination method is a method for determining, during the above-described cooling operation or heating operation, whether refrigerant has leaked from the refrigerant circuit 10.

(4-1) Determination by First Determination Unit

Figure 6:
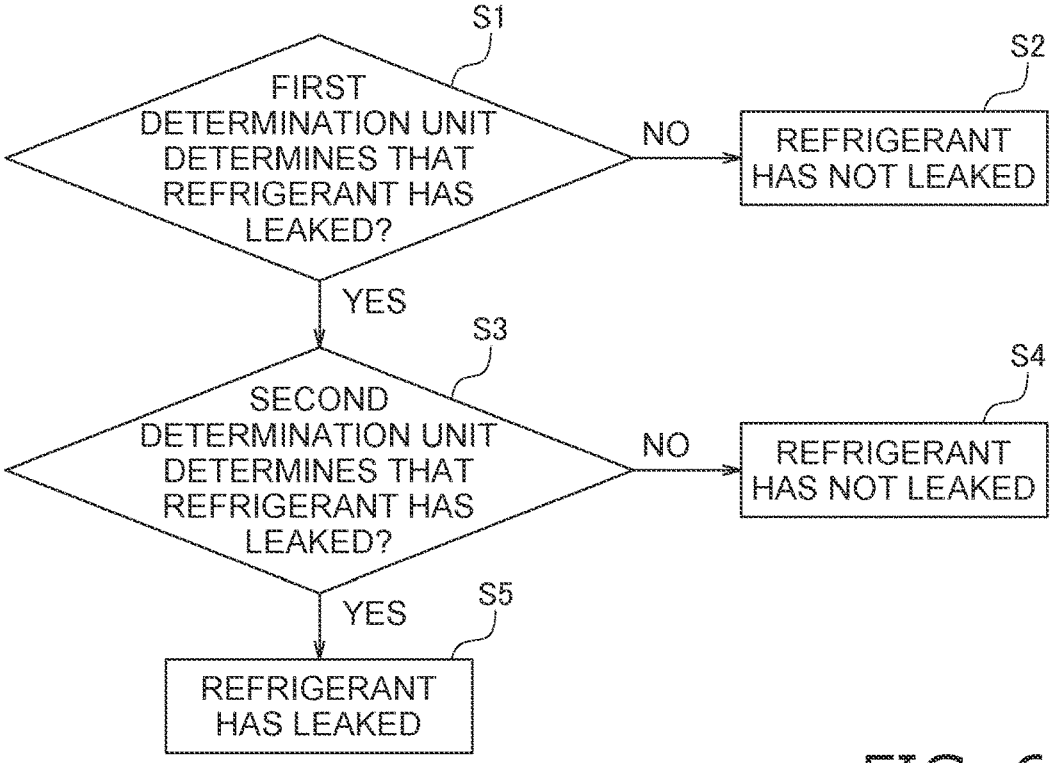
FIG. 6 is a flowchart illustrating a refrigerant leakage determination method according to one embodiment of the present disclosure.

As illustrated in FIG. 6, first, the first determination unit 60 determines that refrigerant has leaked from the refrigerant circuit 10, by using a first state amount of refrigerant as a determination index. The first state amount includes at least an outlet temperature of a condenser, a suction temperature of a compressor, or a discharge temperature of the compressor (step S1). In the present embodiment, as a determination index, a degree of subcooling or an SC corresponding value is used as the first state amount. The first determination unit 60 determines whether refrigerant has leaked in the refrigerant circuit 10, by using the first state amount and a reference value in which refrigerant leakage has not occurred in the refrigerant circuit 10.

If the first determination unit 60 determines in step S1 that refrigerant has not leaked, the verification unit 80 determines that refrigerant has not leaked from the refrigerant circuit 10 (step S2).

On the other hand, if the first determination unit 60 determines in step S1 that refrigerant has leaked, the process proceeds to determination by the second determination unit 70 in step S3.

(4-2) Determination by Second Determination Unit and Verification by Verification Unit Subsequently, the second determination unit 70 determines that refrigerant has leaked from the refrigerant circuit 10, based on information different from the first state amount (step S3). Step S3 is executed, for example, in accordance with the above-described first to eighth methods of the second determination unit 70.

The determination result of the first determination unit 60 in step S1 and the determination result of the second determination unit 70 in step S3 are transmitted to the verification unit 80. The verification unit 80 that has received the determination results of the first determination unit 60 and the second determination unit 70 verifies the determination result of the first determination unit 60 by using the determination result of the second determination unit 70.

If the second determination unit 70 determines in step S3 that refrigerant has not leaked, the verification unit 80 determines that the determination result of the first determination unit 60 is wrong and determines that refrigerant has not leaked from the refrigerant circuit 10 (step S4). On the other hand, if the second determination unit 70 determines in step S3 that refrigerant has leaked, the verification unit 80 determines that the determination result of the first determination unit 60 is correct and determines that refrigerant has leaked from the refrigerant circuit 10 (step S5).

In the refrigerant leakage determination system 1 of the present embodiment, even if the first determination unit 60 determines that refrigerant has leaked, by using a degree of subcooling, a degree of suction superheating, a degree of discharge superheating, and a value corresponding thereto as a determination index, it is possible to prevent a determination from being made that refrigerant has leaked when the second determination unit 70 does not determine, based on other information, that refrigerant has leaked. For this purpose, the second determination unit 70 has a function of eliminating a factor causing an erroneous determination resulting from a failure or the like of the sensor used for determination by the first determination unit 60, an expansion valve, or the like. Thus, the refrigerant leakage determination system 1 is capable of reducing an erroneous determination of a refrigerant leakage. Verifying of the determination result of the first determination unit 60 using the determination result of the second determination unit 70 makes it possible to further reduce an erroneous determination of a refrigerant leakage.

(5) Features

A refrigerant leakage determination system according to a first aspect includes a refrigerant circuit, a first determination unit, and a second determination unit. The refrigerant circuit includes a compressor, a condenser, an expansion mechanism, and an evaporator. The first determination unit determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor. The second determination unit determines that refrigerant has leaked from the refrigerant circuit, based on information different from the first state amount.

In the refrigerant leakage determination system according to the first aspect, even if the first determination unit determines that refrigerant has leaked, it is possible to prevent a determination from being made that refrigerant has leaked when the second determination unit does not determine, based on other information, that refrigerant has leaked. Thus, an erroneous determination of refrigerant leakage can be reduced.

A refrigerant leakage determination system according to a second aspect is the refrigerant leakage determination system according to the first aspect, in which the first determination unit uses, as the first state amount, a degree of subcooling or a value corresponding to the degree of subcooling, the degree of subcooling being a temperature difference between a condensation temperature of a refrigerant in the condenser and the outlet temperature of the condenser.

The above "value corresponding to the degree of subcooling" includes a value obtained by correcting, with another state amount, a difference in physical property value, such as entropy or enthalpy, and also a difference in degree of subcooling or physical property value, between a refrigerant in a saturation state in the condenser and a refrigerant at an outlet of the condenser.

In the refrigerant leakage determination system according to the second aspect, a degree of subcooling or a value corresponding to the degree of subcooling is used as a determination index, and thus an accuracy with which the first determination unit detects a refrigerant leakage can be increased.

A refrigerant leakage determination system according to a third aspect is the refrigerant leakage determination system according to the second aspect, in which the value corresponding to the degree of subcooling is a value corrected by a temperature of outdoor air.

In the refrigerant leakage determination system according to the third aspect, the value corresponding to the degree of subcooling corrected by at least the temperature of outdoor air is used. Thus, an accuracy of detecting a refrigerant leakage can be increased compared to a case of using the degree of subcooling.

A refrigerant leakage determination system according to a fourth aspect is the refrigerant leakage determination system according to the first to third aspects, in which a determination result of the first determination unit is verified by using a determination result of the second determination unit.

In the refrigerant leakage determination system according to the fourth aspect, an accuracy of a determination result of the first determination unit can be increased by the second determination unit, and thus an erroneous determination can be further reduced.

A refrigerant leakage determination system according to a fifth aspect is the refrigerant leakage determination system according to the first to fourth aspects, in which the refrigerant leakage determination system further includes a condenser outlet temperature sensor that measures the outlet temperature of the condenser. The second determination unit detects, by using a value of the condenser outlet temperature sensor, whether the condenser outlet temperature sensor has a failure, to determine that refrigerant has leaked.

In the refrigerant leakage determination system according to the fifth aspect, the second determination unit detects whether the condenser outlet temperature sensor, which is used by the first determination unit to determine that refrigerant has leaked, has a failure. Thus, even if the first determination unit determines that refrigerant has leaked, it is possible to prevent a determination from being made that refrigerant has leaked if the second determination unit detects that the condenser outlet temperature sensor has a failure. Thus, an erroneous determination of a refrigerant leakage can be further reduced.

A refrigerant leakage determination system according to a sixth aspect is the refrigerant leakage determination system according to the first to fifth aspects, in which the refrigerant leakage determination system further includes a discharge pressure sensor that measures a discharge pressure of the compressor. The second determination unit detects, by using a value of the discharge pressure sensor, whether the discharge pressure sensor has a failure, to determine that refrigerant has leaked.

In the refrigerant leakage determination system according to the sixth aspect, the second determination unit detects whether the discharge pressure sensor, which is used by the first determination unit to determine that refrigerant has leaked, has a failure. Thus, even if the first determination unit determines that refrigerant has leaked, it is possible to prevent a determination from being made that refrigerant has leaked if the second determination unit detects that the discharge pressure sensor has a failure. Thus, an erroneous determination of a refrigerant leakage can be further reduced.

A refrigerant leakage determination system according to a seventh aspect is the refrigerant leakage determination system according to the first to sixth aspects, in which the refrigerant leakage determination system further includes an accumulator that stores surplus refrigerant. The second determination unit detects, based on a degree of discharge superheating or a value corresponding to the degree of discharge superheating, whether refrigerant remains inside the accumulator, to determine that refrigerant has leaked, the degree of discharge superheating being a difference between the discharge temperature of the compressor and a condensation temperature of a refrigerant in the condenser.

In the refrigerant leakage determination system according to the seventh aspect, the second determination unit makes it possible to reduce an erroneous determination of a refrigerant leakage resulting from refrigerant remaining inside the accumulator.

A refrigerant leakage determination system according to an eighth aspect is the refrigerant leakage determination system according to the seventh aspect, in which in a case where the degree of discharge superheating or the value corresponding to the degree of discharge superheating is smaller than or equal to a threshold value, the second determination unit determines that refrigerant has not leaked.

In the refrigerant leakage determination system according to the eighth aspect, the second determination unit makes it possible to reduce an erroneous determination of a refrigerant leakage resulting from the degree of discharge superheating or the value corresponding to the degree of discharge superheating being smaller than or equal to the threshold value.

A refrigerant leakage determination system according to a ninth aspect is the refrigerant leakage determination system according to the first to eighth aspects, in which the evaporator is an indoor heat exchanger mounted in an indoor unit. The refrigerant leakage determination system further includes at least one of an evaporator inlet temperature sensor that measures an inlet temperature of the evaporator and an evaporator outlet temperature sensor that measures an outlet temperature. The second determination unit detects, by using a value of at least one of the evaporator inlet temperature sensor and the evaporator outlet temperature sensor, whether at least one of the evaporator inlet temperature sensor and the evaporator outlet temperature sensor has a failure, to determine that refrigerant has leaked.

In the refrigerant leakage determination system according to the ninth aspect, the second determination unit makes it possible to reduce an erroneous determination of a refrigerant leakage resulting from refrigerant remaining inside the accumulator, which is caused by a decrease in the value of the evaporator inlet temperature sensor due to a failure and an increase in the value of the evaporator outlet temperature sensor due to a failure.

A refrigerant leakage determination system according to a tenth aspect is the refrigerant leakage determination system according to the first to ninth aspects, in which the evaporator is an indoor heat exchanger mounted in an indoor unit. The expansion mechanism includes an indoor-side expansion valve mounted in the indoor unit. The second determination unit detects, by using a degree of superheating at an outlet of the indoor heat exchanger and an opening degree of the indoor-side expansion valve, whether the indoor-side expansion valve has a failure, to determine that refrigerant has leaked, the degree of superheating at the outlet of the indoor heat exchanger being a difference between an outlet temperature of the evaporator and an evaporation temperature of a refrigerant in the evaporator.

In the refrigerant leakage determination system according to the tenth aspect, the second determination unit detects whether the indoor-side expansion valve, which is used by the first determination unit to determine that refrigerant has leaked, has a failure. Thus, even if the first determination unit determines that refrigerant has leaked, it is possible to prevent a determination from being made that refrigerant has leaked if the second determination unit detects that the indoor-side expansion valve has a failure. Thus, an erroneous determination of a refrigerant leakage can be further reduced.

A refrigerant leakage determination system according to an eleventh aspect is the refrigerant leakage determination system according to the first to tenth aspects, in which the condenser is an outdoor heat exchanger mounted in an outdoor unit. The refrigerant leakage determination system further includes a subcooling heat exchanger disposed at an outlet side of the condenser. The second determination unit determines that refrigerant has leaked, based on a state amount of refrigerant passing through the subcooling heat exchanger.

In the refrigerant leakage determination system according to the eleventh aspect, the second determination unit is capable of grasping a change in the amount of refrigerant, based on a state amount of refrigerant in the subcooling heat exchanger. Thus, the second determination unit is capable of detecting a refrigerant leakage based on information different from the first state amount, and thus an erroneous determination can be further reduced.

A refrigerant leakage determination system according to a twelfth aspect is the refrigerant leakage determination system according to the eleventh aspect, in which the refrigerant leakage determination system further includes a bypass pipe and a subcooling-heat-exchanger outlet temperature sensor. The bypass pipe connects the subcooling heat exchanger and the compressor. The subcooling-heat-exchanger outlet temperature sensor is disposed at the bypass pipe and measures an outlet temperature of the subcooling heat exchanger. The second determination unit detects, by using a value of the subcooling-heat-exchanger outlet temperature sensor, whether the subcooling-heat-exchanger outlet temperature sensor has a failure, to determine that refrigerant has leaked.

In the refrigerant leakage determination system according to the twelfth aspect, the second determination unit makes it possible to reduce an erroneous determination resulting from a decrease in the discharge temperature of the compressor, which is caused by refrigerant remaining inside the accumulator due a failure of the subcooling-heat-exchanger outlet temperature sensor.

A refrigerant leakage determination system according to a thirteenth aspect is the refrigerant leakage determination system according to the eleventh or twelfth aspect, in which the refrigerant leakage determination system further includes a bypass pipe and a subcooling-heat-exchanger outlet temperature sensor. The bypass pipe connects the subcooling heat exchanger and the compressor. The subcooling-heat-exchanger outlet temperature sensor is disposed at the bypass pipe and measures an outlet temperature of the subcooling heat exchanger. The expansion mechanism includes a subcooling-heat-exchanger-side expansion valve that decompresses a refrigerant which flows through the bypass pipe and which is to enter the subcooling heat exchanger. The second determination unit detects, by using either an outlet temperature of the subcooling heat exchanger or a degree of superheating at an outlet of the subcooling heat exchanger, the degree of superheating at the outlet of the subcooling heat exchanger being a difference between the outlet temperature of the subcooling heat exchanger and an evaporation temperature of a refrigerant in the subcooling heat exchanger, and an opening degree of the subcooling-heat-exchanger-side expansion valve, whether the subcooling-heat-exchanger-side expansion valve has a failure, to determine that refrigerant has leaked.

In the refrigerant leakage determination system according to the thirteenth aspect, the second determination unit makes it possible to reduce an erroneous determination of a refrigerant leakage resulting from refrigerant remaining inside the accumulator, which is caused by a failure of the subcooling-side expansion valve.

A refrigerant leakage determination system according to a fourteenth aspect is the refrigerant leakage determination system according to the first to thirteenth aspects, in which the evaporator is an indoor heat exchanger mounted in an indoor unit. The second determination unit detects dirt of a filter that traps dust in air that is prior to pass through the evaporator, to determine that refrigerant has leaked.

In the refrigerant leakage determination system according to the fourteenth aspect, the second determination unit makes it possible to reduce an erroneous determination resulting from a decrease in the discharge temperature of the compressor, which is caused by refrigerant remaining inside the accumulator due dirt of the filter.

A refrigerant leakage determination system according to a fifteenth aspect is the refrigerant leakage determination system according to the first to fourteenth aspects, in which at least one of the first determination unit and the second determination unit is stored in an external apparatus.

The external apparatus herein is an apparatus outside an apparatus mainly including the refrigerant circuit.

In the refrigerant leakage determination system according to the fifteenth aspect, data required by at least one of the first determination unit and the second determination unit can be accumulated in the external apparatus.

(6) Modifications (6-1) Modification A

In the refrigerant leakage determination system according to the above-described embodiment, the second determination unit 70 determines that refrigerant has leaked, by using all the first to eighth methods. Alternatively, the second determination unit 70 of the present disclosure may adopt one of the above-described first to eighth examples alone, or may combine them as appropriate. However, it is preferable that the second determination unit 70 detect whether each of information acquisition means used by the first determination unit 60 to determine refrigerant leakage (devices such as a sensor and an expansion valve) has a failure, thereby determining that refrigerant has leaked. For example, in a case where the first determination unit 60 determines that a refrigerant has leaked by using a degree of subcooling, which is a temperature difference between a condensation temperature Tc and an outlet temperature Tb of a condenser, or an SC corresponding value as a determination index, the second determination unit 70 detects whether the condenser outlet temperature sensor and the discharge pressure sensor 43 have a failure, thereby determining that refrigerant has leaked.

The second determination unit 70 of the present modification does not adopt a method having a small influence on a refrigerant leakage. For example, the second determination unit 70 determines that refrigerant has leaked, by using the first to seventh methods.

(6-2) Modification B

The refrigerant leakage determination system according to the above-described embodiment includes the verification unit 80 that verifies a determination result of the first determination unit 60 and a determination result of the second determination unit 70. However, the verification unit 80 may be omitted. A refrigerant leakage determination system of the present modification is configured so that determination results of the first determination unit 60 and the second determination unit 70 are recognized.

(6-3) Modification C

In the refrigerant leakage determination system according to the above-described embodiment, the second determination unit 70 detects a failure of a predetermined sensor, and determines, based on whether a failure has occurred, that refrigerant has leaked. However, the second determination unit 70 of the present disclosure may have only a function of detecting whether a failure has occurred. In the present modification, in the case of the above-described first method, the second determination unit 70 detects whether a condenser outlet temperature sensor has a failure by using a value of the condenser outlet temperature sensor. Specifically, the first determination unit 60 determines that refrigerant has leaked. In contrast to this, the second determination unit 70 detects that the condenser outlet temperature sensor has a failure. The verification unit 80 determines, from the detection result of the second determination unit 70, that the determination result of the first determination unit 60 is wrong and determines that refrigerant has not leaked. On the other hand, the second determination unit 70 detects that the condenser outlet temperature sensor does not have a failure. The verification unit 80 determines, from the detection result of the second determination unit 70, that the determination result of the first determination unit 60 is correct and determines that refrigerant has leaked.

(6-4) Modification D

Figure 7:
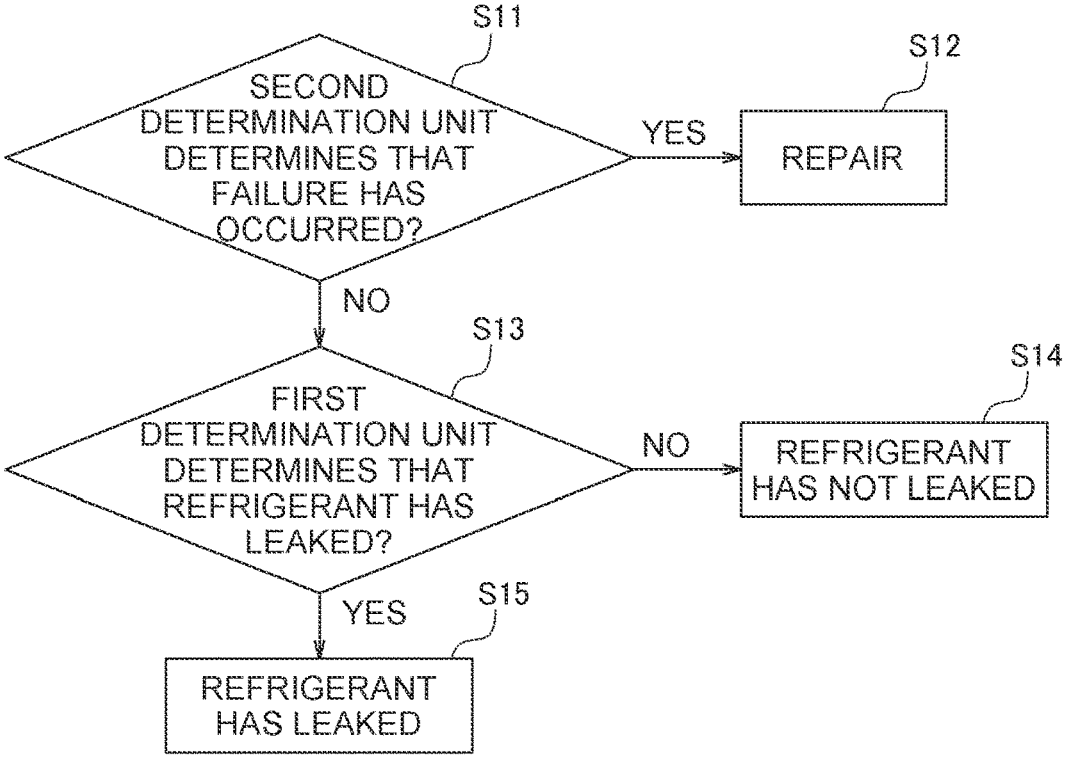
FIG. 7 is a flowchart illustrating a refrigerant leakage determination method according to a modification.

In the refrigerant leakage method using the refrigerant leakage determination system according to the above-described embodiment, a step of determination by the first determination unit 60 (step S1) is performed, and then a step of determination by the second determination unit 70 (step S3) is performed. However, the method is not limited thereto. For example, as illustrated in FIG. 7, a step of determination by the second determination unit 70 (step S11) may be performed, and then a step of determination by the first determination unit 60 (step S13) may be performed.

Specifically, first, the second determination unit 70 detects whether a device for calculating a first state amount used as a determination index by the first determination unit 60 has a failure (step S11). If it is detected in step S11 that the device has a failure, the device having a failure is repaired (step S12). On the other hand, if it is detected in step S11 that the device does not have a failure, a cooling operation or a heating operation is started.

In step S11, it is preferable that the second determination unit 70 detect whether each of all devices used for calculating a first state amount used as a determination index by the first determination unit 60 has a failure. For example, in a case where the first determination unit 60 uses a degree of subcooling or an SC corresponding value as a first state amount, the second determination unit 70 detects whether the condenser outlet temperature sensor and the discharge pressure sensor 43 have a failure. If it is detected in step S11 that at least one device has a failure, the second determination unit 70 determines that the first determination unit 60 is incapable of determining leakage of refrigerant. In this case, the device having a failure is repaired (step S12). On the other hand, if it is detected in step S11 that all devices do not have a failure, the process proceeds to determination by the first determination unit 60 in step S13.

Subsequently, the first determination unit 60 determines that refrigerant has leaked from the refrigerant circuit 10, by using, as a determination index, a degree of subcooling or an SC corresponding value as a first state amount of a refrigerant including at least an outlet temperature of a condenser (step S13). In step S13, the first determination unit 60 determines whether refrigerant has leaked in the refrigerant circuit 10, by using the first state amount and a reference value in which a refrigerant leakage has not occurred in the refrigerant circuit 10. If the first determination unit 60 determines that refrigerant has not leaked, the verification unit 80 determines that refrigerant has not leaked from the refrigerant circuit 10 (step S14). On the other hand, if the first determination unit 60 determines that refrigerant has leaked, the verification unit 80 determines that refrigerant has leaked from the refrigerant circuit 10 (step S15).

(6-5) Modification E

In the outdoor unit 2 according to the above-described embodiment, the subcooling heat exchanger 39 is provided, in the outdoor liquid-refrigerant pipe 26, between the outdoor-side expansion valve 25 and the liquid-side shutoff valve 32. In the outdoor unit 2 according to the present modification, the subcooling heat exchanger 39 is provided, in the outdoor liquid-refrigerant pipe 26, between the outdoor-side expansion valve 25 and the outdoor heat exchanger 24.

(6-6) Modification F

The refrigerant leakage determination system 1 according to the above-described embodiment is a system for determining leakage of a refrigerant in a refrigeration apparatus that cools and heats a room in a building or the like by using a vapor compression refrigeration cycle, but is not limited thereto. The refrigerant leakage determination system of the present disclosure may be applied to a refrigeration apparatus used not for cooling or heating, for example, a hot water supply apparatus.

The embodiments of the present disclosure have been described above. It is to be understood that the embodiments and the details can be variously changed without deviating from the gist and scope of the present disclosure described in the claims.

REFERENCE SIGNS LIST

1 refrigerant leakage determination system
2 outdoor unit
5*a*, 5*b* indoor unit
6 liquid-refrigerant connection pipe
7 gas-refrigerant connection pipe
10 refrigerant circuit
21 compressor
22 compressor motor
23 switching mechanism
24 outdoor heat exchanger
25 outdoor-side expansion valve
26 outdoor liquid-refrigerant pipe
27 suction pipe
28 accumulator
29 discharge pipe
30 first outdoor gas-refrigerant pipe
31 second outdoor gas-refrigerant pipe
32 liquid-side shutoff valve
33 gas-side shutoff valve
34 outdoor fan
35 bypass pipe
36 refrigerant return inlet pipe
37 refrigerant return outlet pipe
38 subcooling-heat-exchanger-side expansion valve
39 subcooling heat exchanger
41 suction pressure sensor
42 suction temperature sensor
43 discharge pressure sensor
44 discharge temperature sensor
45 outdoor-heat-exchanger outlet temperature sensor
46 subcooling-heat-exchanger outlet temperature sensor
47 outdoor temperature sensor
51*a*, 51*b* indoor-side expansion valve
52*a*, 52*b* indoor heat exchanger
53*a*, 53*b* indoor liquid-refrigerant pipe
54*a*, 54*b* indoor gas-refrigerant pipe
55*a*, 55*b* indoor fan
56*a*, 56*b* filter
57*a*, 57*b* indoor-heat-exchanger inlet temperature sensor
58*a*, 58*b* indoor-heat-exchanger outlet temperature sensor
59*a*, 59*b* filter sensor
60 first determination unit
70 second determination unit
80 verification unit

CITATION LIST

Patent Literature

<PTL 1> Japanese Unexamined Patent Application Publication No. 2010-107187

The invention claimed is:

1. A refrigerant leakage determination system comprising:
a refrigerant circuit including a compressor, a condenser, an expansion mechanism, and an evaporator; and
an external server, the external server being external to the refrigerant circuit, wherein
the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, and
the external server is configured to perform a second determination that determines that refrigerant has leaked from the refrigerant circuit, based on information different from the first state amount, wherein
the refrigerant leakage determination system further comprises a condenser outlet temperature sensor that measures the outlet temperature of the condenser, and
the second determination detects, by using a value of the condenser outlet temperature sensor, whether the condenser outlet temperature sensor has a failure, to determine that refrigerant has leaked.

2. The refrigerant leakage determination system according to claim 1, wherein the first determination uses, as the first state amount, a degree of subcooling or a value corresponding to the degree of subcooling, the degree of subcooling being a temperature difference between a condensation temperature of a refrigerant in the condenser and the outlet temperature of the condenser.

3. The refrigerant leakage determination system according to claim 2, wherein the value corresponding to the degree of subcooling is a value corrected by at least a temperature of outdoor air.

4. A refrigerant leakage determination system comprising:
a refrigerant circuit including a compressor, a condenser, an expansion mechanism, and an evaporator; and
an external server, the external server being external to the refrigerant circuit, wherein
the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, and
the external server is configured to perform a second determination that determines that refrigerant has leaked from the refrigerant circuit, based on information different from the first state amount,
wherein a determination result of the first determination is verified by using a determination result of the second determination.

5. A refrigerant leakage determination system comprising:
a refrigerant circuit including a compressor, a condenser, an expansion mechanism, and an evaporator;
an external server, the external server being external to the refrigerant circuit; and
a discharge pressure sensor that measures a discharge pressure of the compressor, wherein
the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor,
the external server is configured to perform a second determination that determines that refrigerant has leaked from the refrigerant circuit, based on information different from the first state amount, and
the second determination detects, by using a value of the discharge pressure sensor, whether the discharge pressure sensor has a failure, to determine that refrigerant has leaked.

6. A refrigerant leakage determination system comprising:
a refrigerant circuit including a compressor, a condenser, an expansion mechanism, and an evaporator;

an external server, the external server being external to the refrigerant circuit; and an accumulator that stores surplus refrigerant, wherein the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, and the external server is configured to perform a second determination that determines that refrigerant has leaked from the refrigerant circuit, based on information different from the first state amount, and the second determination detects, based on a degree of discharge superheating or a value corresponding to the degree of discharge superheating, whether refrigerant remains inside the accumulator, to determine that refrigerant has leaked, the degree of discharge superheating being a difference between the discharge temperature of the compressor and a condensation temperature of a refrigerant in the condenser.

7. The refrigerant leakage determination system according to claim 6, wherein in a case where the degree of discharge superheating or the value corresponding to the degree of discharge superheating is smaller than or equal to a threshold value, the second determination determines that refrigerant has not leaked.

8. A refrigerant leakage determination system comprising:

a refrigerant circuit including a compressor, a condenser, an expansion mechanism, and an evaporator; and an external server, the external server being external to the refrigerant circuit, wherein the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, the external server is configured to perform a second determination that determines that refrigerant has leaked from the refrigerant circuit, based on information different from the first state amount, the evaporator is an indoor heat exchanger mounted in an indoor unit, the refrigerant leakage determination system further comprises at least one of an evaporator inlet temperature sensor that measures an inlet temperature of the evaporator and an evaporator outlet temperature sensor that measures an outlet temperature, and the second determination detects, by using a value of at least one of the evaporator inlet temperature sensor and the evaporator outlet temperature sensor, whether at least one of the evaporator inlet temperature sensor and the evaporator outlet temperature sensor has a failure, to determine that refrigerant has leaked.

9. A refrigerant leakage determination system comprising:

a refrigerant circuit including a compressor, a condenser, an expansion mechanism, and an evaporator; and an external server, the external server being external to the refrigerant circuit, wherein the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, the external server is configured to perform a second determination that determines that refrigerant has leaked from the refrigerant circuit, based on information different from the first state amount, the evaporator is an indoor heat exchanger mounted in an indoor unit, the expansion mechanism includes an indoor-side expansion valve mounted in the indoor unit, and the second determination detects, by using a degree of superheating at an outlet of the indoor heat exchanger and an opening degree of the indoor-side expansion valve, whether the indoor-side expansion valve has a failure, to determine that refrigerant has leaked, the degree of superheating at the outlet of the indoor heat exchanger being a difference between an outlet temperature of the evaporator and an evaporation temperature of a refrigerant in the evaporator.

10. A refrigerant leakage determination system comprising:

a refrigerant circuit including a compressor, a condenser, an expansion mechanism, and an evaporator, the condenser is an outdoor heat exchanger mounted in an outdoor unit;

a subcooling heat exchanger disposed at an outlet side of the condenser;

an external server, the external server being external to the refrigerant circuit;

a bypass pipe that connects the subcooling heat exchanger and the compressor; and a subcooling-heat-exchanger outlet temperature sensor that is disposed at the bypass pipe and measures an outlet temperature of the subcooling heat exchanger, wherein the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, the external server is configured to perform a second determination that determines that refrigerant has leaked from the refrigerant circuit, based on information different from the first state amount, the second determination determines that refrigerant has leaked, based on a state amount of refrigerant passing through the subcooling heat exchanger, and the second determination detects, by using a value of the subcooling-heat-exchanger outlet temperature sensor, whether the subcooling-heat-exchanger outlet temperature sensor has a failure, to determine that refrigerant has leaked.

11. A refrigerant leakage determination system comprising:

a refrigerant circuit including a compressor, a condenser, an expansion mechanism, and an evaporator, the condenser is an outdoor heat exchanger mounted in an outdoor unit;

a subcooling heat exchanger disposed at an outlet side of the condenser;

an external server, the external server being external to the refrigerant circuit;

a bypass pipe that connects the subcooling heat exchanger and the compressor; and a subcooling-heat-exchanger outlet temperature sensor that is disposed at the bypass pipe and measures an outlet temperature of the subcooling heat exchanger, wherein the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, the external server is configured to perform a second determination that determines that refrigerant has leaked from the refrigerant circuit, based on information different from the first state amount, the second determination determines that refrigerant has leaked, based on a state amount of refrigerant passing through the subcooling heat exchanger, and the expansion mechanism includes a subcooling-heat-exchanger-side expansion valve that decompresses a refrigerant which flows through the bypass pipe and which is to enter the subcooling heat exchanger, and the second determination detects, by using either an outlet temperature of the subcooling heat exchanger or a degree of superheating at an outlet of the subcooling heat exchanger, the degree of superheating at the outlet of the subcooling heat exchanger being a difference between the outlet temperature of the subcooling heat exchanger and an evaporation temperature of a refrigerant in the subcooling heat exchanger, and an opening degree of the subcooling-heat-exchanger-side expansion valve, whether the subcooling-heat-exchanger-side expansion valve has a failure, to determine that refrigerant has leaked.

12. A refrigerant leakage determination system comprising:

a refrigerant circuit including a compressor, a condenser, an expansion mechanism, and an evaporator; and an external server, the external server being external to the refrigerant circuit, wherein the external server is configured to perform a first determination that determines that refrigerant has leaked from the refrigerant circuit, by using a first state amount of refrigerant as a determination index, the first state amount including at least one of an outlet temperature of the condenser, a suction temperature of the compressor, and a discharge temperature of the compressor, the external server is configured to perform a second determination that determines that refrigerant has leaked from the refrigerant circuit, based on information different from the first state amount, the evaporator is an indoor heat exchanger mounted in an indoor unit, and the second determination detects dirt of a filter that traps dust in air that is prior to pass through the evaporator, to determine that refrigerant has leaked.

13. The refrigerant leakage determination system according to claim 2, wherein a determination result of the first determination is verified by using a determination result of the second determination.

14. The refrigerant leakage determination system according to claim 3, wherein a determination result of the first determination is verified by using a determination result of the second determination.

15. The refrigerant leakage determination system according to claim 4, further comprising a condenser outlet temperature sensor that measures the outlet temperature of the condenser, wherein the second determination detects, by using a value of the condenser outlet temperature sensor, whether the condenser outlet temperature sensor has a failure, to determine that refrigerant has leaked.

* * * * *